US011667122B2

(12) United States Patent
Inoue et al.

(10) Patent No.: US 11,667,122 B2
(45) Date of Patent: Jun. 6, 2023

(54) LIQUID EJECTING APPARATUS

(71) Applicant: SEIKO EPSON CORPORATION, Tokyo (JP)

(72) Inventors: Ryo Inoue, Matsumoto (JP); Fumiya Takino, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/184,013

(22) Filed: Feb. 24, 2021

(65) Prior Publication Data

US 2021/0268799 A1 Sep. 2, 2021

(30) Foreign Application Priority Data

Feb. 27, 2020 (JP) ..... JP2020-031522

(51) Int. Cl.
*B41J 2/165* (2006.01)

(52) U.S. Cl.
CPC ..... *B41J 2/16538* (2013.01); *B41J 2/16535* (2013.01); *B41J 2/16544* (2013.01); *B41J 2002/16502* (2013.01)

(58) Field of Classification Search
CPC ..... B41J 2/16538; B41J 2/16535; B41J 2/16544; B41J 2002/16502; B41J 2/155; B41J 2/16585; B41J 3/543; B41J 2202/20; B41J 2202/21
See application file for complete search history.

(56) References Cited

U.S. PATENT DOCUMENTS

| | | | | |
|---|---|---|---|---|
| 9,855,750 | B2 * | 1/2018 | Akahane | B41J 2/14201 |
| 2017/0120599 | A1 | 5/2017 | Nawano et al. | |
| 2018/0297362 | A1 | 10/2018 | Okui et al. | |

FOREIGN PATENT DOCUMENTS

| | | |
|---|---|---|
| JP | 2006-321172 | 11/2006 |
| JP | 2017-081115 | 5/2017 |
| JP | 2018-149746 | 9/2018 |
| JP | 2018-176717 | 11/2018 |

* cited by examiner

*Primary Examiner* — Geoffrey S Mruk
(74) *Attorney, Agent, or Firm* — Workman Nydegger

(57) ABSTRACT

A liquid ejecting apparatus includes: a first liquid ejecting head having a first wiping surface oriented in a first direction; a second liquid ejecting head disposed in a second direction orthogonal to the first direction with respect to the first liquid ejecting head and having a second wiping surface; and a wiping member. A third direction is orthogonal to the first and second directions; a fourth direction is vertical to the first direction and intersects the second and third directions. The first and second liquid ejecting heads are arranged with a gap between the first and second wiping surfaces. The gap includes a first gap extending in the fourth direction. The first wiping surface has a first region that protrudes toward the second liquid ejecting head beyond an imaginary line extending in the fourth direction so as to overlap the first gap.

17 Claims, 14 Drawing Sheets

LIQUID EJECTING APPARATUS

The present application is based on, and claims priority from JP Application Serial Number 2020-031522, filed Feb. 27, 2020, the disclosure of which is hereby incorporated by reference herein in its entirety.

BACKGROUND

1. Technical Field

The present disclosure relates to liquid ejecting apparatuses.

2. Related Art

JP-A-2018-149746 discloses a liquid ejecting apparatus that includes: a head unit in which a plurality of liquid ejecting heads are arranged side by side with gaps therebetween; spacers embedded in the respective gaps; and wipers that remove liquid from the head unit. Those spacers allow the wipers to move into the gaps, thereby suppressing the liquid from splashing around the head unit.

The above liquid ejecting apparatus, however, may involve a complicated process of assembling the head unit and require some additional components, which leads to cost rise.

SUMMARY

The present disclosure is a liquid ejecting apparatus that includes a first liquid ejecting head which discharges a liquid in a first direction. This first liquid ejecting head has a first wiping surface oriented in the first direction. A second liquid ejecting head, which is disposed in a second direction of the first liquid ejecting head, has a second wiping surface oriented in the first direction, the second direction being orthogonal to the first direction. A wiping member wipes the first wiping surface and the second wiping surface. A third direction is orthogonal to both the first direction and the second direction; a fourth direction is vertical to the first direction and intersects both the second direction and the third direction. The first liquid ejecting head and the second liquid ejecting head are arranged with a gap between the first wiping surface and the second wiping surface as viewed from a direction opposite to the first direction. The gap includes a first gap extending in the fourth direction. The first wiping surface has a first region that protrudes toward the second liquid ejecting head beyond an imaginary line that extends in the fourth direction so as to overlap the first gap as viewed from the direction opposite to the first direction.

DESCRIPTION OF EXEMPLARY EMBODIMENTS

A. First Embodiment

Figure 1:
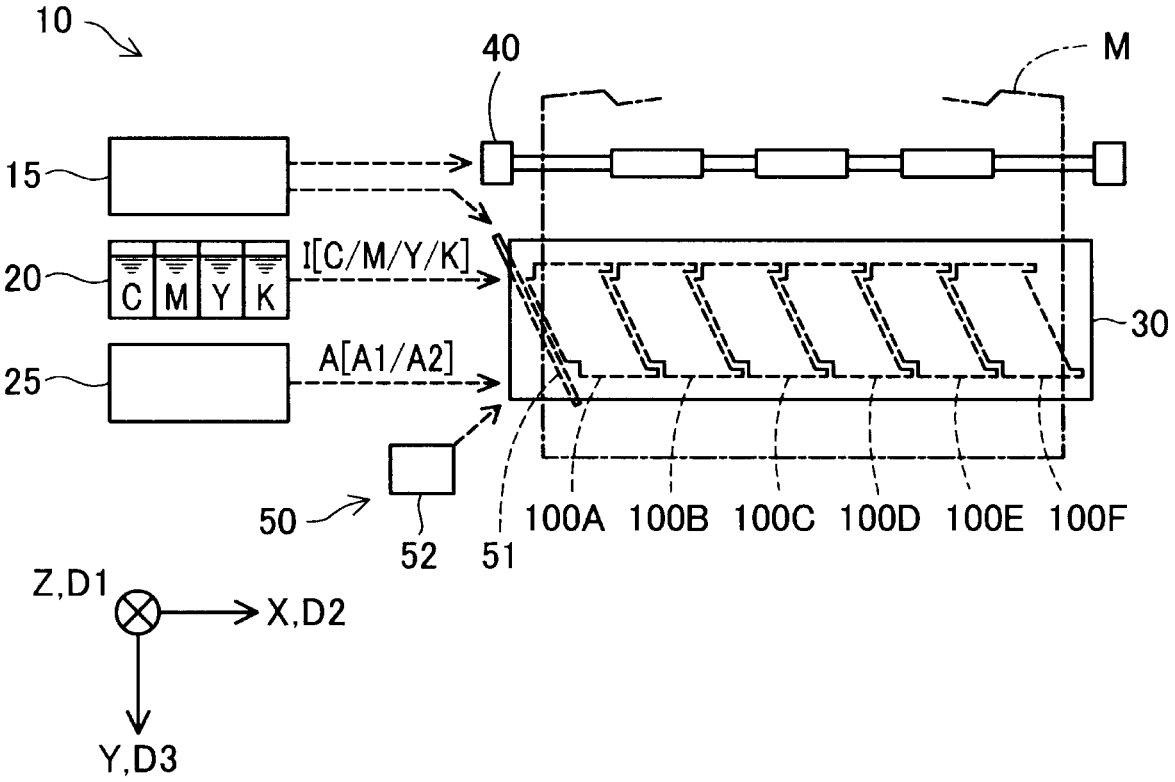
FIG. 1 schematically illustrates a configuration of a liquid ejecting apparatus according to a first embodiment of the present disclosure.

FIG. 1 schematically illustrates a configuration of a liquid ejecting apparatus 10 according to a first embodiment of the present disclosure. In FIG. 1, X, Y, and Z directions, which are orthogonal to one another, are indicated by respective arrows. The X and Y directions are each parallel to the horizontal plane, whereas the Z direction is identical to the direction of gravitational force. The arrows of X, Y, and Z directions are also illustrated similarly in the other drawings. To specify its orientation herein, each direction is denoted by a positive mark "+" or a negative mark "−". Hereinafter, the +Z direction may also be referred to below as a first direction D1; the +X direction may also be referred to below as a second direction D2; and the +Y direction may also be referred to below as a third direction D3.

In this embodiment, the liquid ejecting apparatus 10 is an ink jet printer that discharges inks I as liquids onto a print medium M, thereby printing a desired image thereon. More specifically, the liquid ejecting apparatus 10 receives image data from an external device such as an external computer over wired or wireless communication and converts the image data into print data, which indicates the layout of dots to be formed on the print medium M. Then, the liquid ejecting apparatus 10 discharges the inks I onto the print medium M in accordance with the print data, thereby forming dots thereon at predetermined locations to print a desired image.

The liquid ejecting apparatus 10 includes a controller 15, a liquid container 20, a pump 25, a head unit 30, a transport mechanism 40, and a wiping mechanism 50. The controller 15 may be implemented by a computer that includes: one or more processors; main memory; and an input/output interface through which signals are to be transmitted to or received from an external device. The controller 15 performs various functions by causing the processors to read and execute programs and commands stored in the main memory. Examples of those functions include: converting received image data into print data; and controlling both the head unit 30 and the transport mechanism 40 in accordance with the print data.

The liquid container 20 stores the inks I to be discharged onto the print medium M. In this embodiment, the liquid container 20 includes four independent containers that store cyan, magenta, yellow, and black inks I, which are coupled to the head unit 30 through respective tubes, for example.

The head unit 30 includes a plurality of liquid ejecting heads arranged side by side in the second direction D2. In this embodiment, the head unit 30 includes a first liquid ejecting head 100A, a second liquid ejecting head 100B, a third liquid ejecting head 100C, a fourth liquid ejecting head 100D, a fifth liquid ejecting head 100E, and a sixth liquid ejecting head 100F, which are arranged side by side in this order in the second direction D2. The head unit 30 separately supplies the inks I from the liquid container 20 to the liquid ejecting heads 100A to 100F and then causes the liquid ejecting heads 100A to 100F to discharge the inks I onto the print medium M under the control of the controller 15. Herein, the head unit 30 may also be referred to below as the line head. It should be noted that the liquid ejecting heads are denoted by the reference characters 100A to 100F in order to discriminate from one another, but they may be denoted simply by reference numeral 100 when the discrimination is unnecessary. The head unit 30 does not necessarily have to have six liquid ejecting heads 100. Alternatively, the head unit 30 may have any other number of liquid ejecting heads 100; for example, the head unit 30 may have any of one to five and seven or more liquid ejecting heads 100. Although the head unit 30 is implemented by a line head in this embodiment, it may also be implemented by a serial printer, in which case the head unit 30 may discharge the inks I onto the print medium M while reciprocating over the print medium M to form an image thereon.

The transport mechanism 40 feeds the print medium M under the control of the controller 15. In this embodiment, the transport mechanism 40 feeds the print medium M in the third direction D3. For example, the transport mechanism 40 includes: rollers that feed the print medium M; and a motor that rotates the rollers.

The pump 25 supplies air A to the head unit 30 through two systems under the control of the controller 15. The pump 25 is coupled to the head unit 30 by two tubes, through which air A1 and air A2 for respect systems are supplied to open or close valves disposed inside the head unit 30.

The wiping mechanism 50 includes a wiping member 51 and a wiping driver 52. The wiping member 51 may be a rubber blade in this embodiment; however, it may also be a cloth. The wiping driver 52 may include a guide rail and a motor. The wiping driver 52 moves the wiping member 51 relative to the head unit 30 in the second direction D2 under the control of the controller 15, thereby removing the inks I and foreign matter from the head unit 30. Alternatively, the wiping driver 52 may move the wiping member 51 relative to the head unit 30 in the direction opposite to the second direction D2 in order to remove the inks I and foreign matter from the head unit 30. A concrete shape of the wiping member 51 will be described later. Although the wiping driver 52 moves the wiping member 51 relative to the head unit 30 in this embodiment, it may also move the head unit 30 relative to the wiping member 51 in the second direction D2 or the opposite direction.

Figure 2:
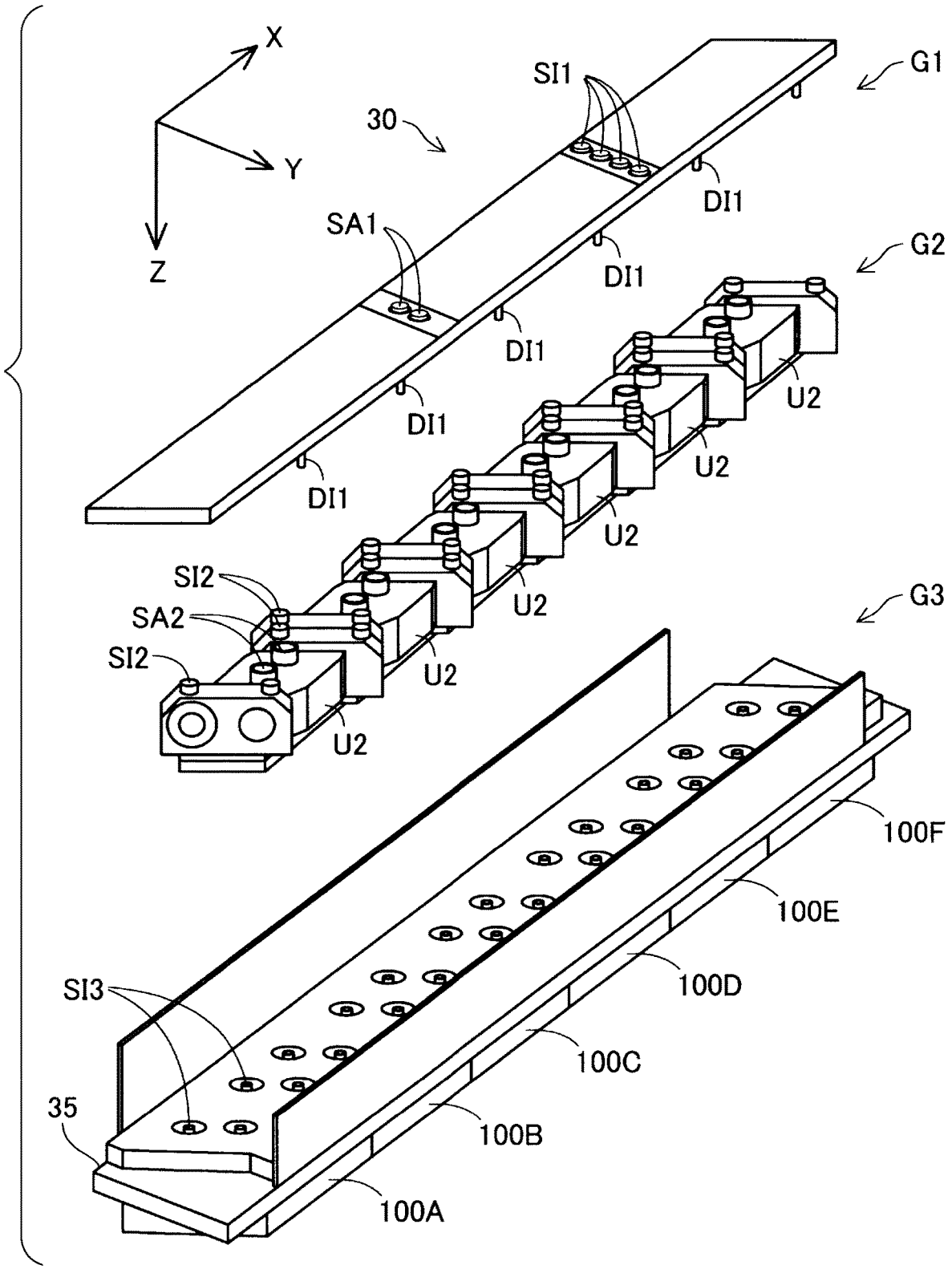
FIG. 2 is a first exploded perspective view of a configuration of the head unit.
Figure 3:
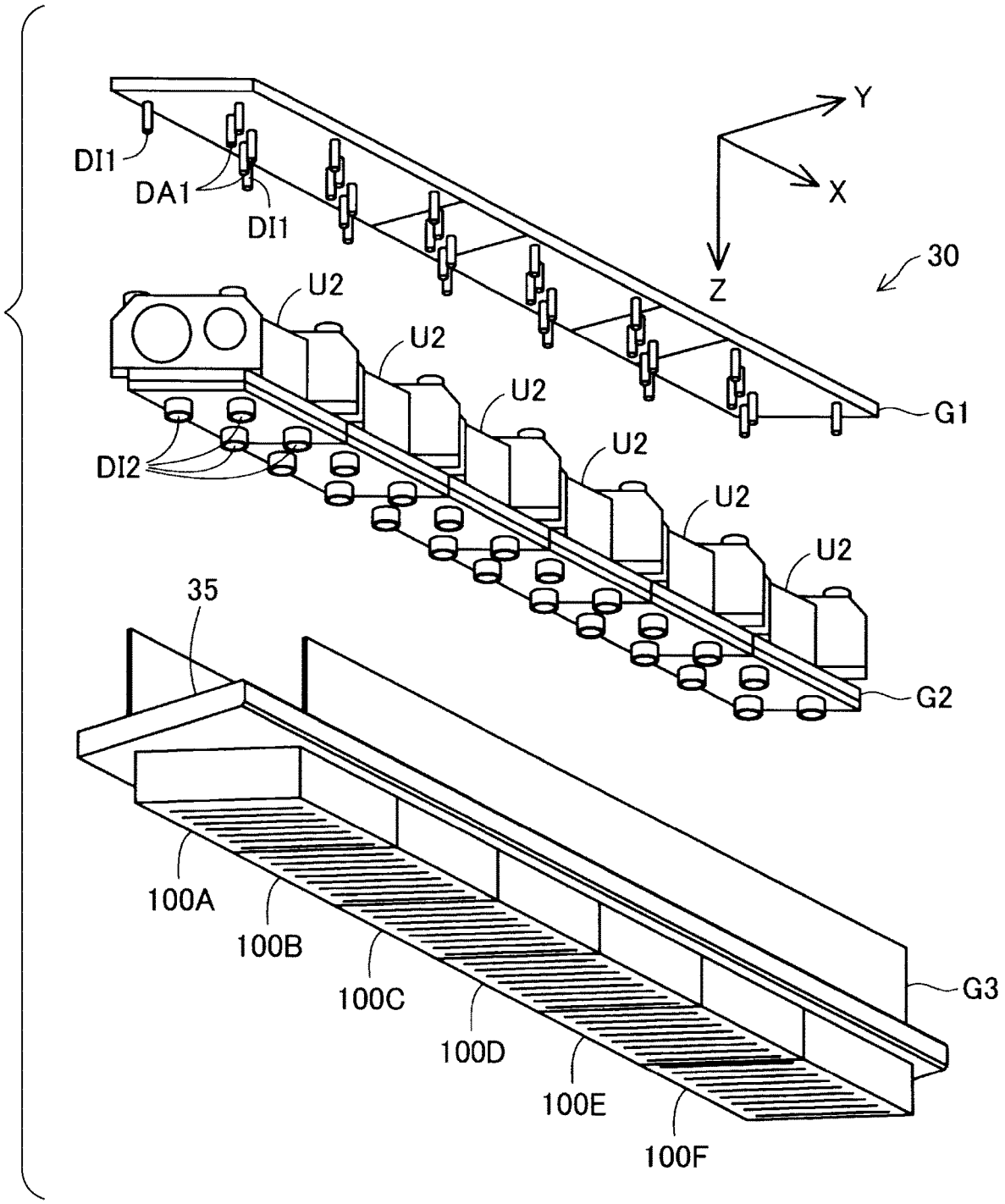
FIG. 3 is a second exploded perspective view of the configuration of the head unit.
Figure 4:
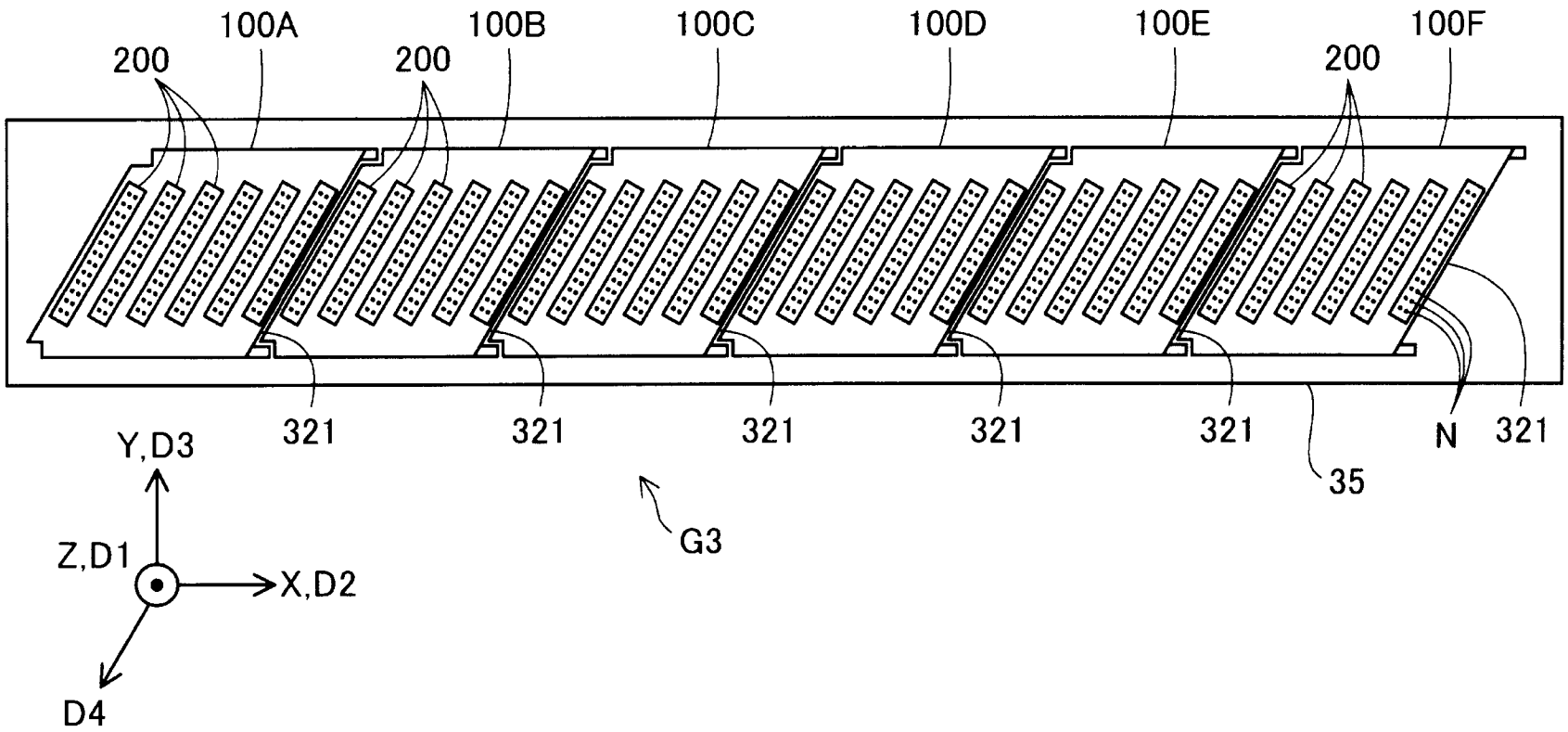
FIG. 4 is a bottom view of the configuration of the head unit.

FIG. 2 is a first exploded perspective view of a configuration of the head unit 30; FIG. 3 is a second exploded perspective view of the configuration of the head unit 30; and FIG. 4 is a bottom view of the configuration of the head unit 30. As illustrated in FIGS. 2 and 3, the head unit 30 includes a passage structure G1, a passage controller G2, and a liquid ejector G3.

The passage structure G1 includes first liquid supply ports SI1 in relation to the number of colored types of the inks I and also includes first liquid discharge ports DI1 in relation to the number of colored types of the inks I and the number of liquid ejecting heads 100. In this embodiment, the passage structure G1 has four first liquid supply ports SI1 and 24 first liquid discharge ports DI1. The first liquid supply ports SI1 are coupled to the liquid container 20 through respective tubes. The passage structure G1 further includes passages inside along which the four colored types of inks I flow. Each of the passages leads to one first liquid supply port SI1 and six first liquid discharge ports DI1. The passage structure G1 further includes two first air supply ports SA1 and 12 first air discharge ports DA1. The first air supply ports SA1 are coupled to the pump 25 through the respective tubes. The passage structure G1 further includes passages inside along which the air A flows through the two systems. Each of the passages for the air A leads to one first air supply port SA1 and six first air discharge ports DA1.

The passage controller G2 includes six pressure adjustment units U2 in relation to the number of liquid ejecting heads 100. Each of the pressure adjustment units U2 includes four second liquid supply ports SI2 and four second liquid discharge ports DI2. The second liquid supply ports SI2 are coupled to the respective first liquid discharge ports DI1. Each pressure adjustment unit U2 further includes passages along which the four colored types of inks I flow. Each of these passages leads to one second liquid supply port SI2 and one second liquid discharge port DI2. Each pressure adjustment unit U2 further includes: valves that open or close the respective passages; valves that regulate the pressures of the inks I flowing along the respective passages; two second air supply ports SA2; and passages inside along which the air A flows through the two systems. Each of these passages leads to one second air supply port SA2 and one valve to be driven by the air A supplied through the corresponding passage.

The liquid ejector G3 includes: the six liquid ejecting heads 100A to 100F; and a support member 35. All of the liquid ejecting heads 100A to 100F are fixed to the support member 35 with screws (not illustrated) or an adhesive agent, for example. Each of the liquid ejecting heads 100A to 100F includes four third liquid supply ports SI3. The support member 35 has a surface with apertures through which the third liquid supply ports SI3 are exposed to the outside. The third liquid supply ports SI3 are coupled to the corresponding second liquid discharge ports DI2. In this embodiment, the support member 35 may be made of a conductive material such as a metal. For example, the support member 35 is formed by die-casting aluminum. The support member 35 is grounded by an earth wire. Alternatively, the support member 35 may be made of a resin material.

Next, a description will be given of the flow of an ink I from the liquid container 20 to the liquid ejecting heads 100. When the ink I is supplied from the liquid container 20 to the passage structure G1 through tubes (not illustrated) and the first liquid supply port SI1, the ink I flows along the corresponding passages in the passage structure G1. Then, the ink I flows out therefrom through the corresponding first liquid discharge ports DI1 and in turn flows into the pressure adjustment units U2 through the corresponding second liquid supply ports SI2. After flowing along the corresponding passages in the pressure adjustment units U2, the ink I flows out therefrom through the corresponding second liquid discharge ports DI2 and then flows into the liquid ejecting heads 100 through the corresponding third liquid supply ports SI3. In this case, the passage structure G1 acts as a distributing passage member that individually supplies the inks I to the liquid ejecting heads 100 in the head unit 30. It should be noted that both of the passage structure G1 that acts as the distributing passage member and the support member 35 to which the liquid ejecting heads 100 are fixed may be integrated into a single member. Alternatively, the liquid ejecting head 100 may be fixed to the support member 35 that acts as the distributing passage member without the pressure adjustment unit U2 therebetween.

In this embodiment, as illustrated in FIG. 4, each of the liquid ejecting heads 100A to 100F has six head chips 200 arranged side by side in the second direction D2. Each of the head chips 200 has a plurality of nozzles N through which the inks I are to be discharged and which are arrayed in a fourth direction D4; the fourth direction D4 is vertical to the first direction D1 and orthogonal to both the second direction D2 and the third direction D3. The nozzles N arrayed in this manner is referred to as the nozzle array. In this embodiment, each head chip 200 has two nozzle arrays. All the nozzles are divided into the four nozzle groups: a cyan-ink nozzle group, a magenta-ink nozzle group, a yellow-ink nozzle group, and a black-ink nozzle group. Although six head chips 200 are provided in each of the liquid ejecting heads 100A to 100F in this embodiment, any other plural number of head chips 200 may be provided therein.

Figure 5:
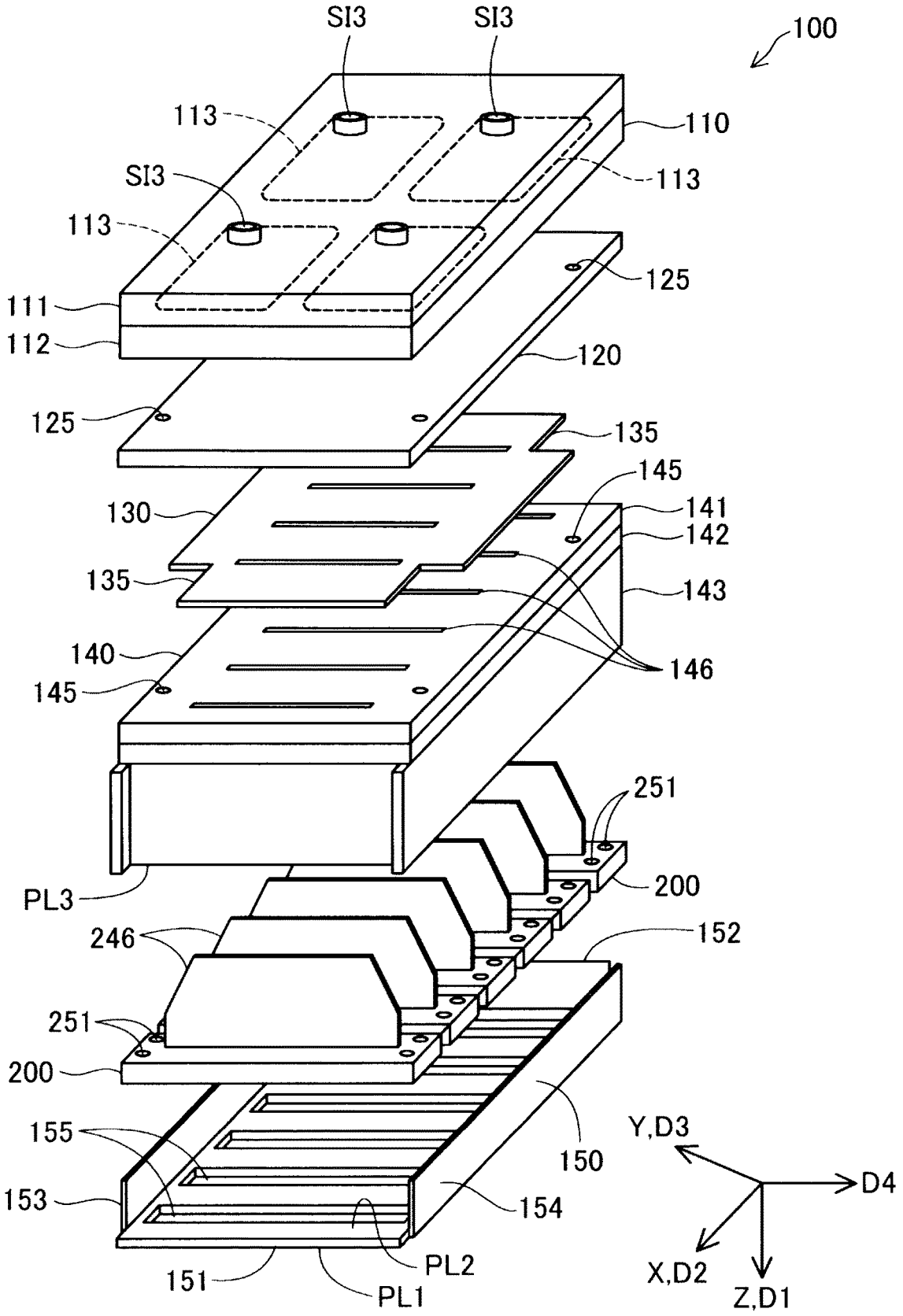
FIG. 5 is a schematic exploded perspective view of a configuration of a liquid ejecting head.

FIG. 5 is a schematic exploded perspective view of a configuration of a liquid ejecting head 100. The liquid ejecting head 100 corresponds to any one of the first liquid ejecting heads 100A to 100F. The liquid ejecting head 100 includes a filter section 110, a sealing member 120, a first interconnection substrate 130, a holder 140, six head chips 200, and a fixed plate 150. More specifically, in the liquid ejecting head 100, the fixed plate 150, the holder 140, the first interconnection substrate 130, the sealing member 120, and the filter section 110 are stacked in this order from the bottom. In addition, the head chips 200 are disposed between the holder 140 and the fixed plate 150. The holder 140 in the first liquid ejecting head 100A is referred to below as a first holder 140A; the holder 140 in the second liquid ejecting head 100B is referred to below as a second holder 140B. The fixed plate 150 in the first liquid ejecting head 100A may also be referred to below as a first fixed plate 150A; the fixed plate 150 in the second liquid ejecting head 100B may also be referred to below as a second fixed plate 150B.

The filter section 110, which has a substantially parallelogram shape as viewed in the first direction D1, includes a first member 111, a second member 112, and a plurality of filters 113. The filter section 110 includes: four third liquid supply ports SI3 at or near the respective corners; and four filters 113 disposed inside in relation to the third liquid supply ports SI3. Each of the filters 113 is used to remove bubbles and foreign matter from the inks I. In this embodiment, both of the first member 111 and the second member 112 may be made of a resin material, such as Xyron (registered trademark [TM]) or a liquid crystal polymer.

The sealing member 120, which has a substantially parallelogram shape as viewed in the first direction D1, has four through-holes 125 at the respective corners through which the inks I supplied from the filter section 110 flow. In this embodiment, the sealing member 120 may be made of an elastic material such as rubber. The sealing member 120 allows liquid discharge holes (not illustrated) formed across the filter section 110 to lead to corresponding liquid supply ports 145 (described later) in the holder 140, in a fluid-tight manner.

The first interconnection substrate 130, which has a substantially parallelogram shape as viewed in the first direction D1, has four notches 135 at the respective corners in order not to cover the through-holes 125 in the sealing member 120. The first interconnection substrate 130 has wiring patterns through which drive signals are to be supplied to and source voltages are to be applied to the head chips 200.

The holder 140, which has a substantially rectangular, cuboid shape, includes a first holder member 141, a second holder member 142, and a third holder member 143, all of which are stacked on top of one another in this embodiment. In the embodiment, all of the first holder member 141, the second holder member 142, and the third holder member 143 may be made of a resin material such as Xyron™ or a liquid crystal polymer. The second holder member 142 may be bonded to both the first holder member 141 and the third holder member 143 with an adhesive agent; each of the head chips 200 may be bonded to the third holder member 143 with an adhesive agent.

The holder 140 includes the four liquid supply ports 145 on the upper surface, which lead to the respective through-holes 125 in the sealing member 120. The holder 140 further includes passages inside along which the inks I are separately supplied from each liquid supply port 145 to the six head chips 200; these passages are formed for each liquid supply port 145. The holder 140 further includes slit vias 146 into which second interconnection substrates 246 of the head chip 200 (described later) are inserted. A more detailed configuration of the holder 140 will be described later.

The fixed plate 150 includes a planar section 151, a first bent section 152, a second bent section 153, and a third bent section 154. In this embodiment, the fixed plate 150 may be made of a metal material such as stainless steel.

Figure 6:
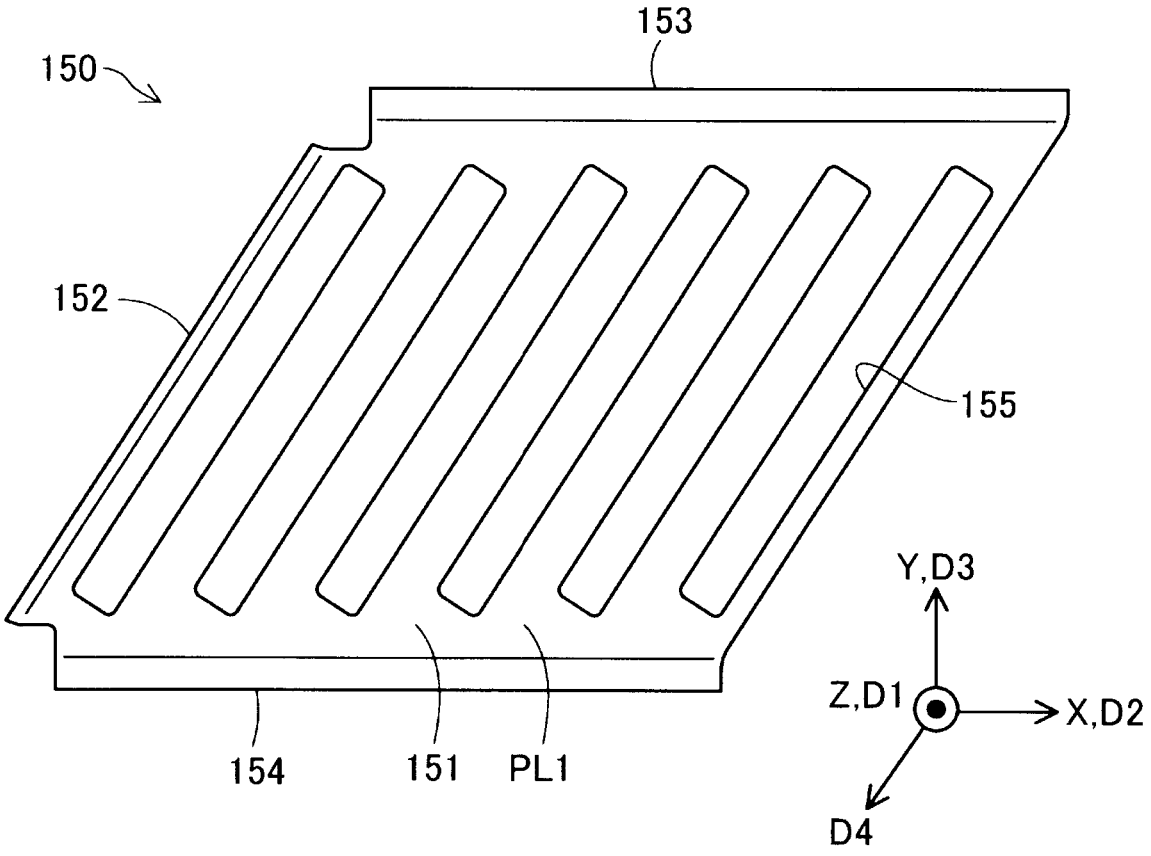
FIG. 6 is a bottom view of a configuration of the fixed plate.

FIG. 6 is a bottom view of a configuration of the fixed plate 150. As illustrated in FIGS. 5 and 6, the planar section 151, which has a substantially rectangular shape as viewed from the direction opposite to the first direction D1, has a first surface PL1 and a second surface PL2; the first surface PL1 is oriented in the first direction D1, whereas the second surface PL2 is oriented in the opposite direction. The six head chips 200 and the third holder member 143 may be all bonded to the second surface PL2 with an adhesive agent. The planar section 151 has a plurality of apertures 155 through which the head chips 200 are exposed to the outside. In this embodiment, the planar section 151 may have six apertures 155 in relation to the respective head chips 200.

The first bent section 152 to the third bent section 154 may be formed by bending a portion of the fixed plate 150 in the direction opposite to the first direction D1. More specifically, the first bent section 152 to the third bent section 154 may be formed by bending the portions of the fixed plate 150 at an obtuse angle with respect to the planar section 151. The first bent section 152 is erected from the side of the planar section 151 in the direction opposite to the second direction D2; the second bent section 153 is erected from the side of the planar section 151 in the third direction D3; and the third bent section 154 is erected from the side of the planar section 151 in the direction opposite to the third direction D3.

Figure 7:
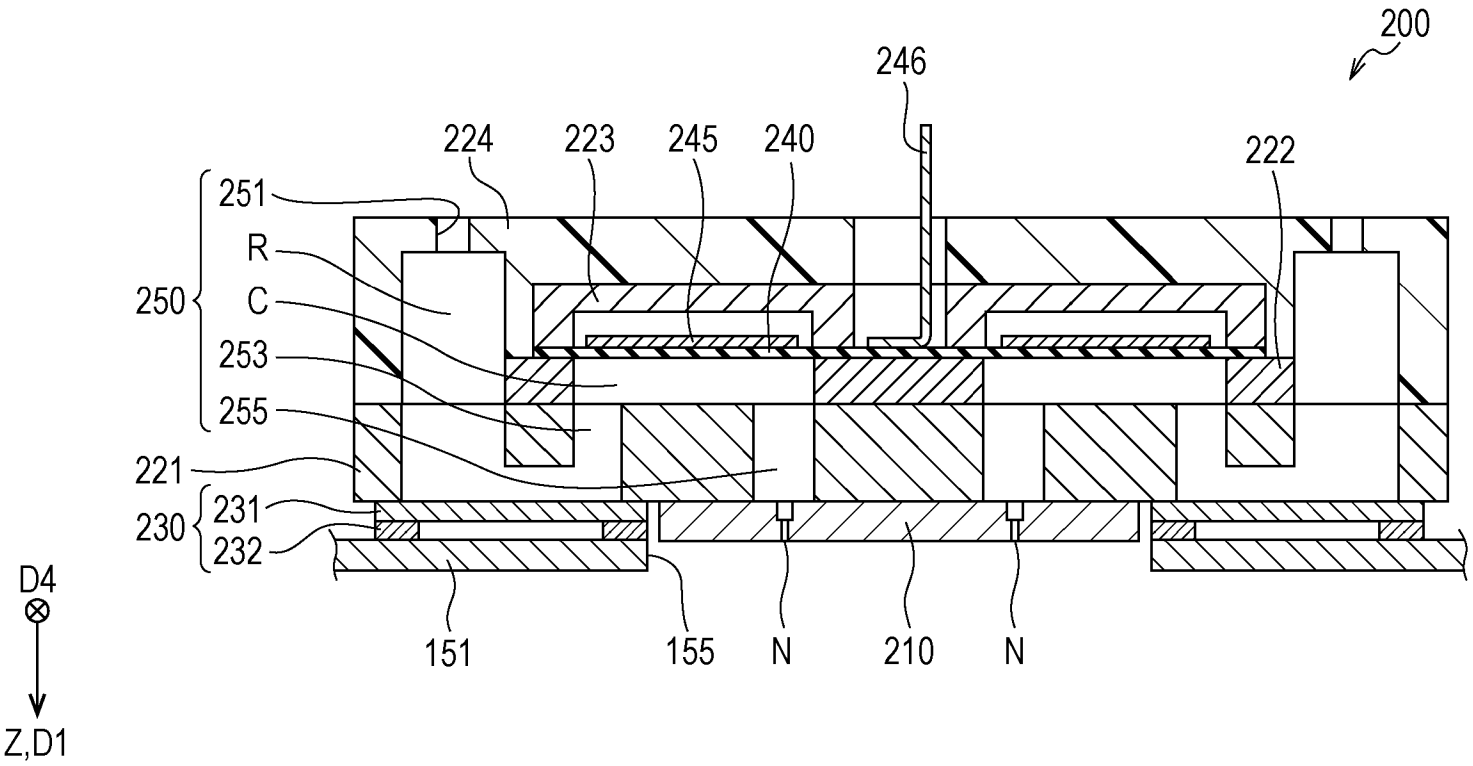
FIG. 7 is a schematic view of a configuration of a head chip.

FIG. 7 is a schematic view of a configuration of a head chip 200. More specifically, FIG. 7 illustrates a cross-section of a single head chip 200 taken along a line vertical to the fourth direction D4. The head chip 200 includes a nozzle plate 210 with a plurality of nozzles N through which the inks I are to be discharged; a passage forming substrate 221 that defines communication passages 255, individual passages 253, and reservoir chambers R; a pressure chamber substrate 222 that defines pressure chambers C; a protection substrate 223; compliance sections 230; a vibration plate 240; piezoelectric elements 245; the second interconnection substrate 246; and a case 224 that defines the reservoir chambers R and liquid supply ports 251.

The head chip 200 is provided with the liquid supply ports 251 through which the inks I are to be supplied from the liquid discharge ports 315 in the holder 140 to passages 250, the reservoir chambers R, the individual passages 253, the pressure chambers C, and the communication passages 255. The passages 250 for the inks I are formed by stacking the passage forming substrate 221, the pressure chamber substrate 222, and the case 224 on top of one another. When supplied into the case 224 through the liquid supply ports 251, the inks I are stored in the reservoir chambers R. Each of the reservoir chamber R is a common passage that communicates with a plurality of individual passages 253 related to the respective nozzles N constituting a single nozzle array. The inks I stored in the reservoir chambers R are supplied to the pressure chambers C through the individual passages 253. Then, the inks I are pressurized inside the pressure chambers C and discharged to the outside through the communication passages 255 and the nozzles N. In the head chip 200, an individual passage 253, a pressure chamber C, and a communication passage 255 are provided for each nozzle N. The case 224 may be made of a resin material such as Xyron™ or a liquid crystal polymer. In this embodiment, all of the nozzle plate 210, the passage forming substrate 221, and the pressure chamber substrate 222 may be made of monocrystal silicon. The passage forming substrate 221 may be bonded to both the nozzle plate 210 and the pressure chamber substrate 222 with an adhesive agent.

The nozzle plate 210 and the compliance sections 230 are fixed to the bottom surface of the passage forming substrate 221. Further, the nozzle plate 210 with nozzles N is fixed to the bottom surface of the passage forming substrate 221 immediately below the communication passages 255. Each of the compliance sections 230 is fixed to the bottom surface of the passage forming substrate 221 immediately below the corresponding reservoir chamber R and individual passage 253. Each compliance section 230 includes a sealing film 231 and support bodies 232. The sealing film 231 is a film member that may be made of a flexible material. The sealing film 231 seals the passage forming substrate 221 immediately below the corresponding reservoir chamber R and individual passage 253. The support bodies 232, each of which may have a rod shape, support the sealing film 231 at its peripheral locations. The bottom surfaces of the support bodies 232 are fixed to the second surface PL2 of the planar section 151 of the fixed plate 150. The compliance sections 230 help suppress varying pressures of the inks I inside the reservoir chambers R and the individual passages 253.

The upper sides of the pressure chambers C are hermetically covered with the vibration plate 240. In this embodiment, the vibration plate 240 includes a stack of an elastic film member made of oxide silicon and an insulating film member made of zirconium oxide, for example. Alternatively, the elastic film member of the vibration plate 240 and the pressure chamber substrate 222 may be integrated into a single member. Provided on the upper surface of the vibration plate 240 are the piezoelectric elements 245 each of which acts as a driver element. Each of the piezoelectric elements 245 includes: a piezoelectric body; and electrodes on both surfaces of the piezoelectric body. The electrodes of each piezoelectric element 245 are electrically connected to the corresponding second interconnection substrate 246 mounted inside the case 224. The second interconnection substrates 246 are electrically connected to the first interconnection substrate 130. The piezoelectric elements 245 receive drive signals from the controller 15 through the second interconnection substrates 246 and then vibrate together with the vibration plate 240 to vary the inner volumes of the pressure chambers C. Decreasing the inner volumes of the pressure chambers C pressurizes the inks I inside the pressure chambers C, thereby discharging the inks I to the outside through the nozzles N. It should be noted that, instead of the piezoelectric elements 245, heating elements may be used as driver elements.

Figure 8:
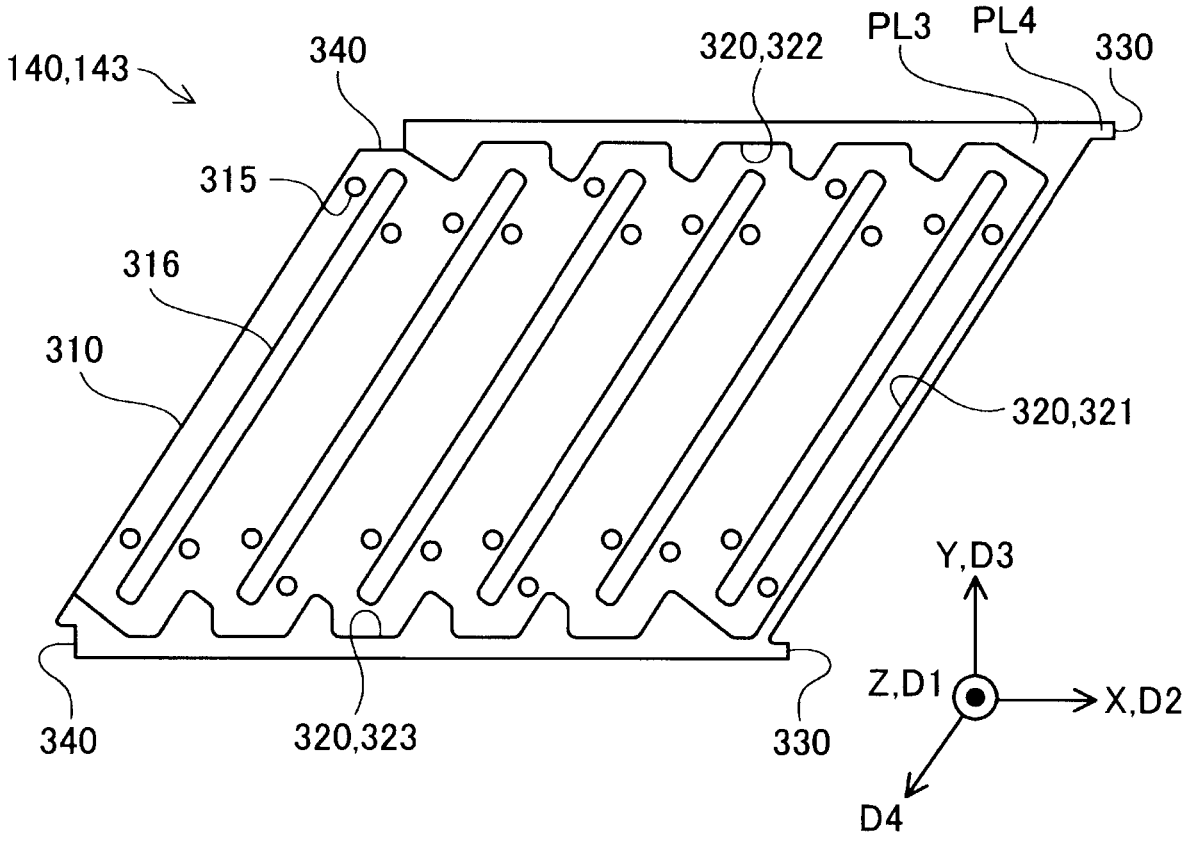
FIG. 8 is a bottom view of a configuration of the holder.
Figure 9:
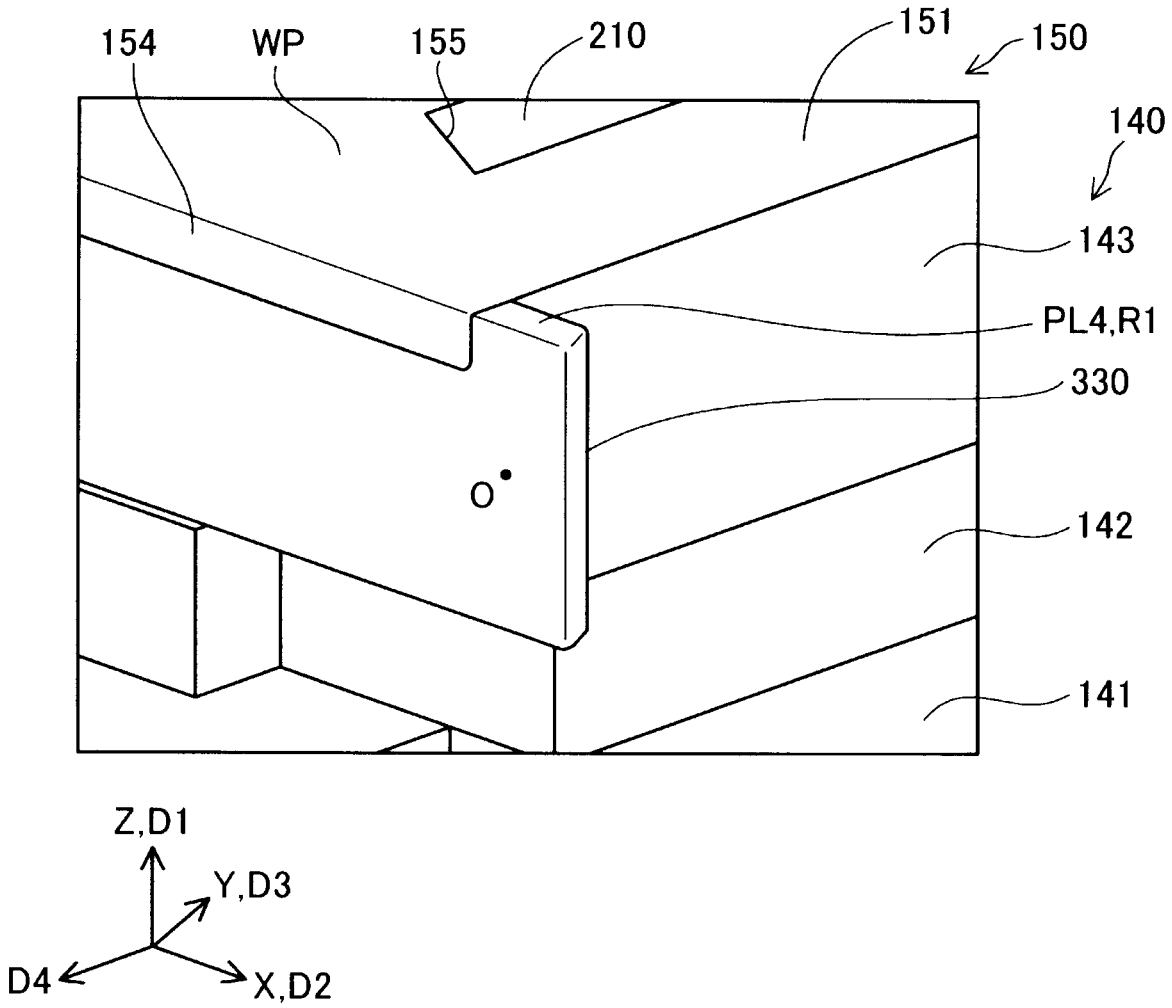
FIG. 9 is a perspective view of a first projection of the holder.

FIG. 8 is a bottom view of a configuration of the holder 140; FIG. 9 is a perspective view of a first projection 330 of the holder 140. The holder 140 includes a main body 310, walls 320, first projections 330, and notches 340. The main body 310 is fixed to the six head chips 200. For example, the surface of the main body 310 which is oriented in the first direction D1 is bonded, with an adhesive agent, to the surfaces of the cases 224 of the head chips 200 which is oriented in the direction opposite to the first direction D1. The main body 310 further includes: six slit vias 316 into which the second interconnection substrates 246 of the head chips 200 are inserted; and the 24 liquid discharge ports 315 that lead to the liquid supply ports 251 in the head chips 200.

The walls 320, which are erected from the main body 310 in the first direction D1, has a third surface PL3 that is oriented in the first direction D1 and is fixed to the second surface PL2 of the fixed plate 150. In this embodiment, the walls 320 include three walls: a first wall 321, a second wall 322, and a third wall 323. The first wall 321 is formed on the side of the main body 310 in the second direction D2 so as to be erected therefrom in the fourth direction D4; the second wall 322 is formed on the side of the main body 310 in third direction D3 so as to be erected therefrom in the second direction D2; and the third wall 323 is formed on the side of the main body 310 in the direction opposite to the third direction D3 so as to be erected therefrom in the second direction D2. The first wall 321 is coupled to both the second wall 322 and the third wall 323. The third surface PL3 is a single continuous plane defined by the bottom sides of the first wall 321, the second wall 322, and the third wall 323.

The first projections 330 are formed on the sides of the first wall 321 in the third direction D3 and in the direction opposite to the third direction D3 so as to protrude therefrom in the second direction D2. Each of the first projections 330 has a fourth surface PL4 that is oriented in the first direction D1 and continues to the third surface PL3 of the first wall 321. As illustrated in FIG. 9, a first projection 330 protrudes from a fourth surface PL4 beyond a center O, in the first direction D1, of the junction between the main body 310 and each wall 320 of the third holder member 143. In this embodiment, the first projection 330 protrudes from the fourth surface PL4 to the surface of the third holder member 143 in the direction opposite to the first direction D1. The center O, in the first direction D1, of the junction between the main body 310 and each wall 320 of the third holder member 143 may also be referred to as the center O, in the first direction D1, of the junction between the main body 310 and each wall 320 of the holder 140.

The notches 340 are formed on the sides of the second wall 322 and the third wall 323 in the direction opposite to the second direction D2. Forming the notches 340 in this manner can help reduce the interference between the third holder member 143 (or the holder 140) and the first projection 330 of the liquid ejecting head 100 disposed next to the third holder member 143.

Figure 10:
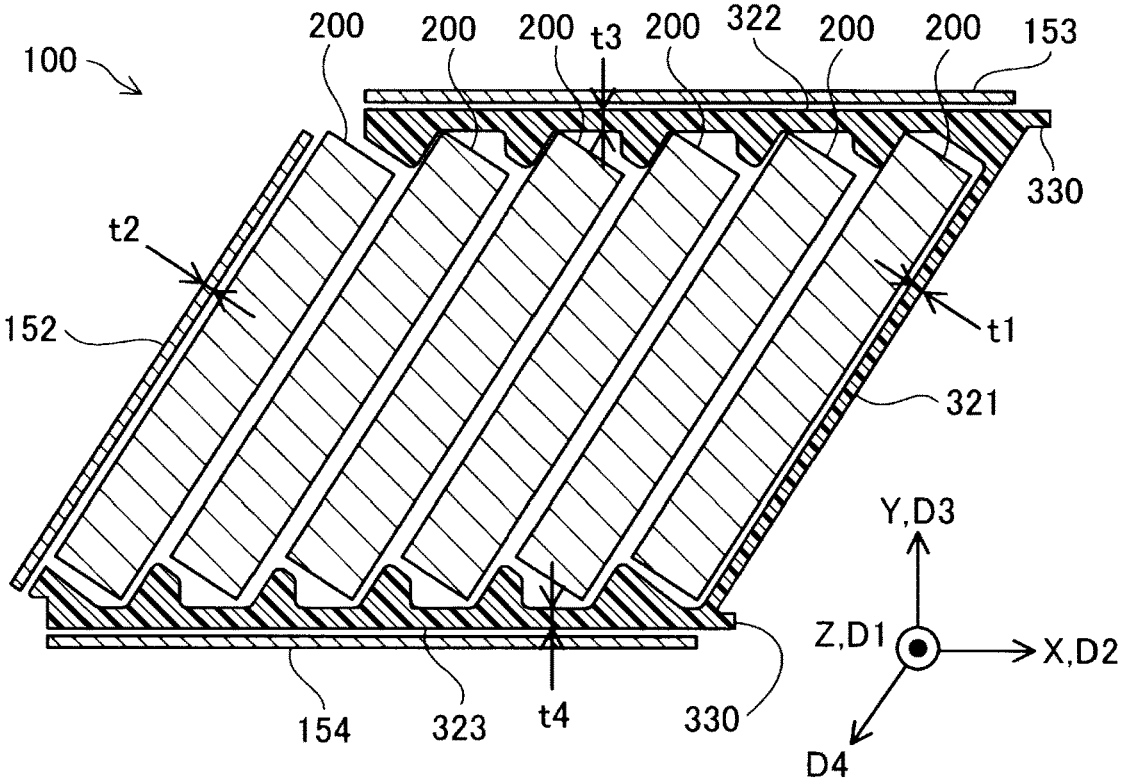
FIG. 10 is a first cross-sectional view of a configuration of a liquid ejecting head.
Figure 11:
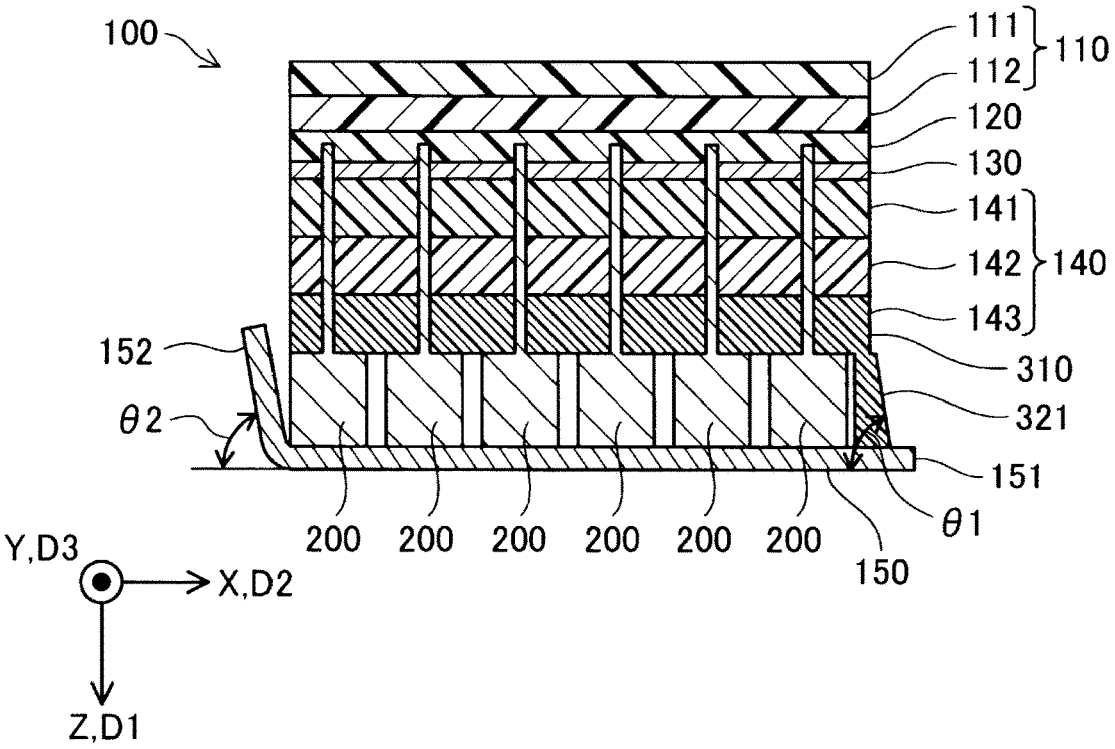
FIG. 11 is a second cross-sectional view of the configuration of the liquid ejecting head.

FIG. 10 is a first cross-sectional view of a configuration of a liquid ejecting head 100; FIG. 11 is a second cross-sectional view of the configuration of the liquid ejecting head 100. More specifically, FIG. 10 illustrates a cross-section of the liquid ejecting head 100 taken along a line that is vertical to the first direction D1 and intersects the first bent section 152, the second bent section 153, and the third bent section 154 of the fixed plate 150. FIG. 11 illustrates a cross-section of the liquid ejecting head 100 taken along a line that is vertical to the third direction D3 and passes through the center of the liquid ejecting head 100 in the third direction D3. As illustrated in FIG. 10, the six head chips 200 are arranged inside the space surrounded by both the holder 140 and the fixed plate 150. The first wall 321, the second wall 322, and the third wall 323 of the holder 140 and the first bent section 152 of the fixed plate 150 correspond to sidewalls surrounding the head chips 200. The first wall 321 of the holder 140 is positioned opposite the sides of the head chips 200 in the second direction D2; the first bent section 152 of the fixed plate 150 is positioned opposite the sides of the head chips 200 in the direction opposite to the second direction D2; the second wall 322 of the holder 140 is positioned opposite the ends of the head chips 200 in the third direction D3; and the third wall 323 of the holder 140 is positioned opposite the ends of the head chips 200 in the direction opposite to the third direction D3. Herein, the first wall 321 of the holder 140 may also be referred to as a first sidewall; the first bent section 152 of the fixed plate 150 may also be referred to as a second sidewall; the second wall 322 of the holder 140 may also be referred to as a third sidewall; and the third wall 323 of the holder 140 may also be referred to as a fourth sidewall.

The first wall 321, which is coupled to both the second wall 322 and the third wall 323, is positioned adjacent to one of the head chips 200 closest to the side in the second direction D2, whereas the first bent section 152 is positioned adjacent to one of the head chips 200 closest to the side in the second direction D2. The head chips 200 are arranged between the first wall 321 and the first bent section 152 in the second direction D2 and between the second wall 322 and the third wall 323 in the third direction D3. The outer surfaces of the first wall 321 and the first bent section 152 are exposed to the outside of the liquid ejecting head 100. The outer surface of the second wall 322 of the holder 140 is covered with the second bent section 153 of the fixed plate 150, whereas the outer surface of the third wall 323 of the holder 140 is covered with the third bent section 154 of the fixed plate 150. The holder 140 is not present between the first bent section 152 and one of the head chips 200 closest to the side in the direction opposite to the second direction D2. A thickness t1 of the first wall 321 is set to be smaller than a thickness t3 of the second wall 322 and a thickness t4 of the third wall 323. The thickness t1 of the first wall 321 refers to the minimum thickness of the portion of the first wall 321 which faces and covers one of the head chips 200 closest to the side in the second direction D2. The thickness t3 of the second wall 322 refers to the minimum thickness of the portion of the second wall 322 which faces and covers the ends of the head chips 200 in the third direction D3. The thickness t4 of the third wall 323 refers to the minimum thickness of the portion of the third wall 323 which faces and covers the ends of the head chips 200 in the direction opposite to the third direction D3. A thickness t2 of the first bent section 152 is set to be smaller than the thickness t1 of the first wall 321. In this embodiment, the thickness t1 of the first wall 321 may be set to approximately 0.71 mm, whereas the thickness of the material for the fixed plate 150, namely, the thickness t2 of the first bent section 152 may be set to approximately 0.08 mm.

Referring to the cross-section vertical to the third direction D3 in FIG. 11, the first wall 321 partly protrudes from the main body 310 in the second direction D2. Furthermore, the end of the planar section 151 of the fixed plate 150 in the second direction D2 protrudes from the first wall 321 in the second direction D2. The outer surface of the first wall 321 forms an angle θ1 with the first surface PL1 of the planar section 151 which is vertical to the first direction D1. The outer surface of the first bent section 152 forms an angle θ2 with the first surface PL1 of the planar section 151. In this case, the angle θ1 is set to be substantially equal to the angle θ2. In other words, both of the first wall 321 and the first bent section 152 are inclined at substantially the same angle with respect to the first surface PL1 vertical to the first direction D1. It should be noted that the angles θ1 and θ2 are basically equal to each other; however, they may differ from each other by approximately 1° or less due to a manufacturing error.

As illustrated in FIG. 4, the individual liquid ejecting heads 100, which constitute the head unit 30, are arranged such that the first walls 321 are oriented in substantially the same direction. In this embodiment, the first walls 321 are arranged so that their outer surfaces are oriented in the direction vertical to the fourth direction D4. In this case, the interval, in the second direction D2, between adjacent head chips 200 in each liquid ejecting head 100 are set to be substantially equal to the distance, in the second direction D2, between the opposing head chips 200 in the adjacent liquid ejecting heads 100. It should be noted that the interval, in the second direction D2, between adjacent head chips 200 in each liquid ejecting head 100 may differ from the distance, in the second direction D2, between the opposing head chips 200 in the adjacent liquid ejecting heads 100 by equal to or less than half the interval between adjacent nozzles N in the second direction D2. In this embodiment, the difference may be approximately 10 μm or less.

Figure 12:
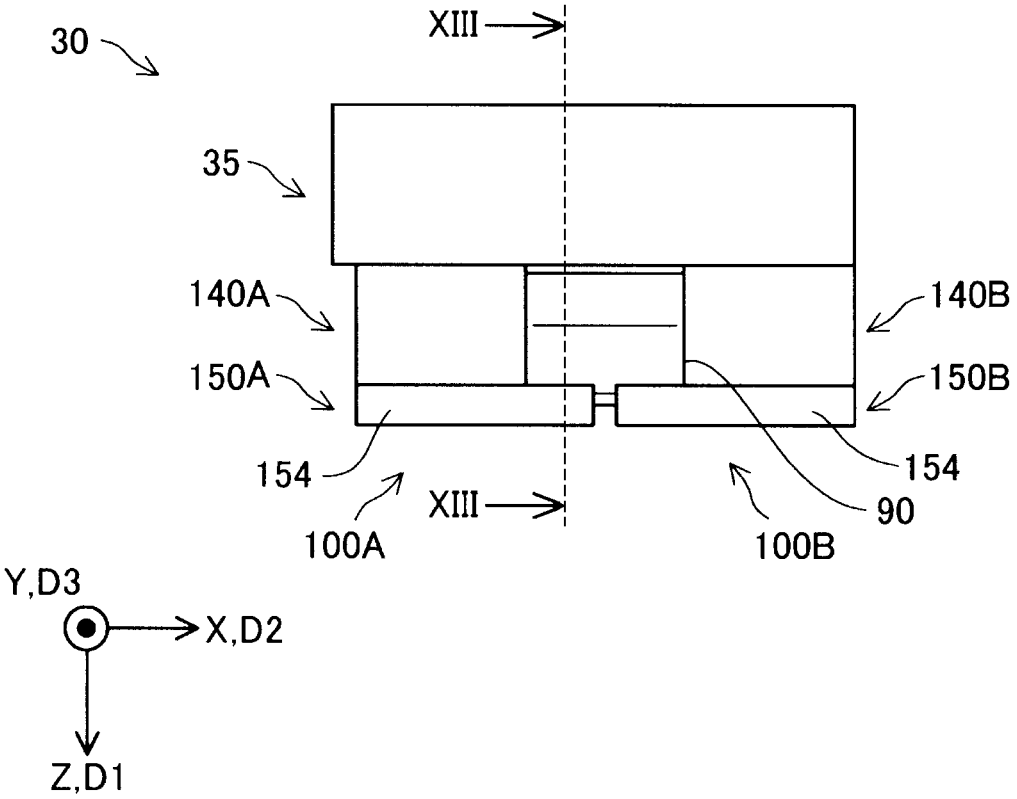
FIG. 12 illustrates a configuration of a conductive plate in the head unit.
Figure 13:
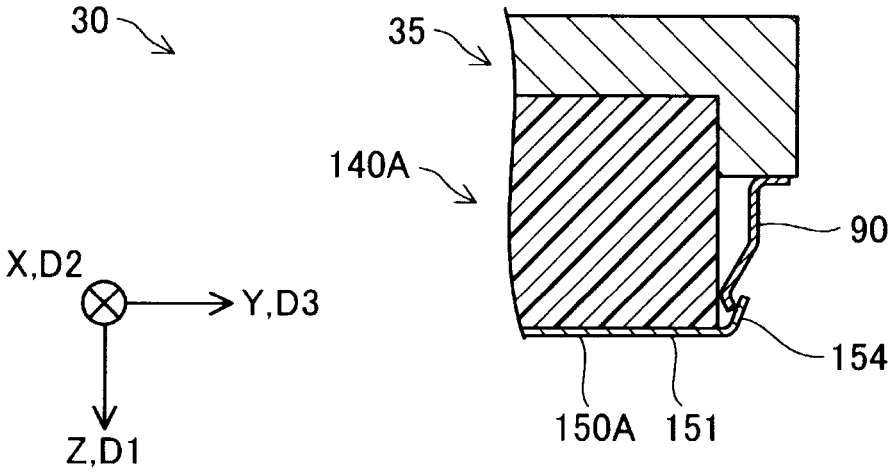
FIG. 13 is a cross-sectional view of the conductive plate taken along line XIII-XIII of FIG. 12.

FIG. 12 illustrates a configuration of a conductive plate 90 in the head unit 30. FIG. 13 is a cross-sectional view of the conductive plate 90 taken along line XIII-XIII of FIG. 12. The conductive plate 90 is provided so as to partly cover the surfaces of each adjacent pair of the liquid ejecting heads 100A to 100F which are oriented in the direction opposite to the third direction D3. FIG. 12 illustrates the conductive plate 90 provided so as to partly cover both the first liquid ejecting head 100A and the second liquid ejecting head 100B. More specifically, the conductive plate 90 partly covers the rear surfaces of the first liquid ejecting head 100A and the second liquid ejecting head 100B which are oriented in the direction opposite to the third direction D3. The conductive plate 90 may be formed by bending a rectangular conductive blade spring. The conductive plate 90 is fixed at its one side to the support member 35 with a screw, for example. The other side of the conductive plate 90 is kept in contact with the inner surfaces of the third bent sections 154 of the first fixed plate 150A in the first liquid ejecting head 100A and the second fixed plate 150B in the second liquid ejecting head 100B. The conductive plate 90 is brought into contact with both the first fixed plate 150A in the first liquid ejecting head 100A and the second fixed plate 150B in the second liquid ejecting head 100B, thereby electrically connecting the support member 35 to both the first fixed plate 150A and the second fixed plate 150B. In this case, the support member 35 is grounded by the earth wire. Thus, both the first fixed plates 150A and 150B that are electrically connected to the support member 35 via the conductive plate 90 are also grounded. The conductive plate 90 may have a notch between the portions in contact with the first fixed plate 150A in the first liquid ejecting head 100A and the second fixed plate 150B in the second liquid ejecting head 100B. Although the conductive plates 90 may be provided on the surfaces of the liquid ejecting heads 100A to 100F which are oriented in the third direction D3, the conductive plates 90 may be provided on the surfaces of the liquid ejecting heads 100A to 100F which are oriented in the third direction D3 as well as in the direction opposite to the third direction D3.

Figure 14:
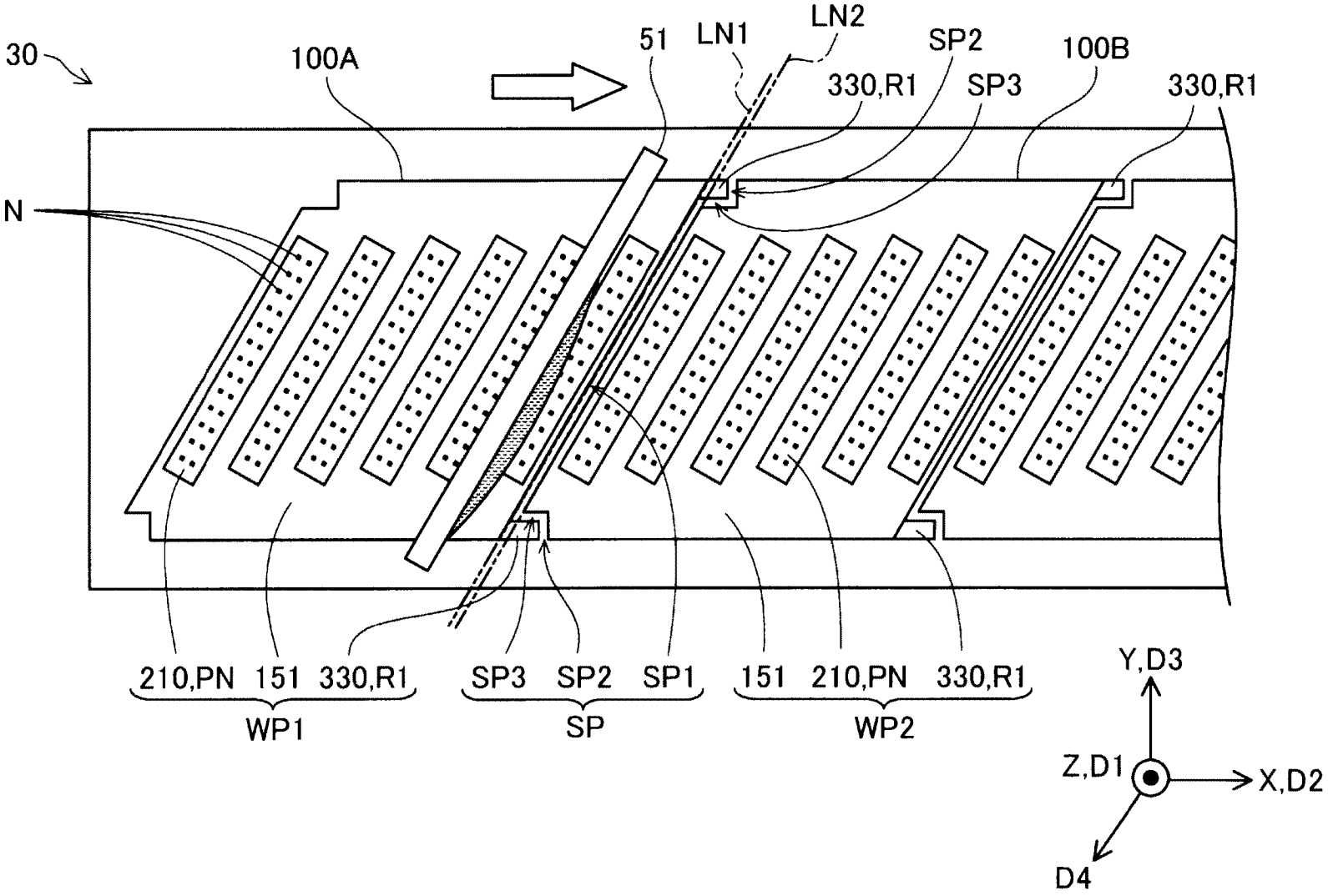
FIG. 14 is a first view of a process in which wiping surfaces of the liquid ejecting heads are being wiped.
Figure 15:
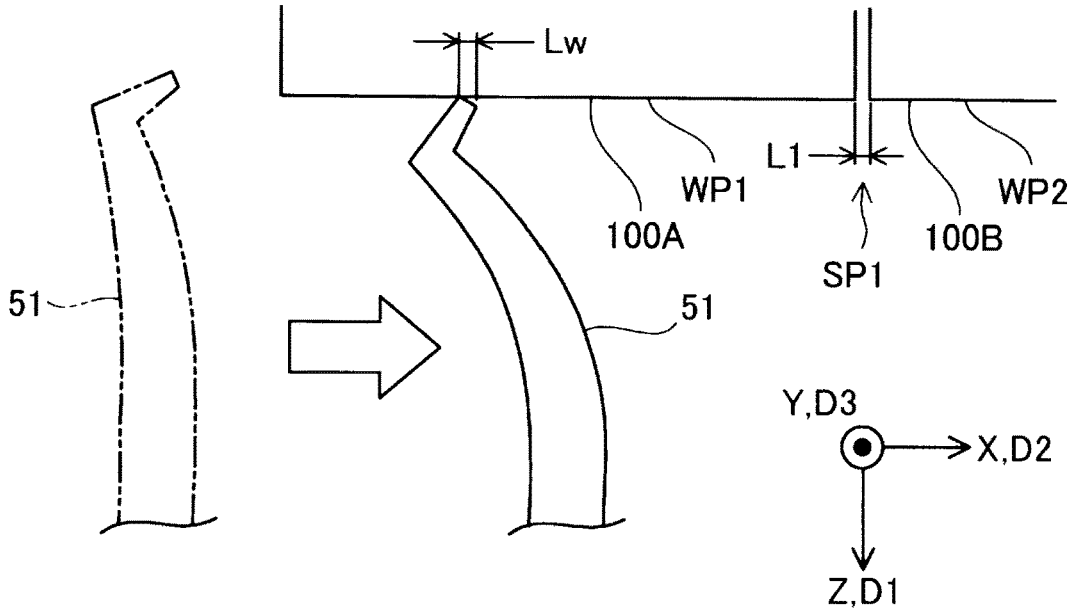
FIG. 15 is a second view of the process in which the wiping surfaces of the liquid ejecting heads are being wiped.

FIG. 14 is a first view of a process in which wiping surfaces WP of the liquid ejecting heads 100 are being wiped; FIG. 15 is a second view of the process in which the wiping surfaces WP of the liquid ejecting heads 100 are being wiped. The wiping member 51 wipes, at predetermined timings, the first surfaces PL1 of the fixed plates 150 in the liquid ejecting heads 100 and the portions of the surfaces of the nozzle plates 210 which are exposed to the outside through the apertures 155 of the fixed plates 150. Thereinafter, the portions of the surfaces of the nozzle plates 210 which are exposed to the outside through the apertures 155 of the fixed plates 150 are each referred to as a nozzle surface PN. The first surface PL1 of the fixed plate 150 in the first liquid ejecting head 100A and the corresponding nozzle surface PN are collectively referred to as a first wiping surface WP1. The first surface PL1 of the fixed plate 150 in the second liquid ejecting head 100B and the corresponding nozzle surface PN are collectively referred to as a second wiping surface WP2. Each of the first wiping surface WP1 and the second wiping surface WP2 is referred to simply as the wiping surface WP1 when not need to be distinguished from each other.

As illustrated in FIG. 14, the wiping member 51 wipes the wiping surfaces WP of the liquid ejecting heads 100 by moving relative to the liquid ejecting heads 100 in the second direction D2. In this embodiment, the wiping member 51 may have a rectangular shape as viewed from the direction opposite to the first direction D1 and extend in the fourth direction D4. The wiping member 51 is longer than the wiping surface WP1 of each liquid ejecting head 100 in the fourth direction D4. As illustrated in FIG. 15, an end of the wiping member 51 is curved in the second direction D2.

As illustrated in FIG. 14, when the wiping member 51 moves relative to the liquid ejecting head 100 in the second direction D2 in order to remove the inks I from the wiping surface WP1, the inks I flow along the wiping member 51 in the direction opposite to the third direction D3. In this case, formed between the first surfaces PL1 of the fixed plates 150 and the nozzle surfaces PN are steps, each of which has a height substantially equal to the thickness of the fixed plates 150. In this embodiment, the apertures 155 in each fixed plate 150 have a rectangular shape, longer sides of which extend in the fourth direction D4 in which the wiping member 51 also extends and a short side of which extends in the direction orthogonal to the fourth direction D4, as viewed from the direction opposite to the first direction D1. This configuration brings the end of the wiping member 51 into contact with the nozzle surfaces PN smoothly, thereby successfully wiping the nozzle surfaces PN without leaving the inks I thereon.

The first liquid ejecting head 100A and the second liquid ejecting head 100B are arranged with a gap SP between the first wiping surface WP1 and the second wiping surface WP2 as viewed from the direction opposite to the first direction D1. The gap SP includes a first gap SP1, second gaps SP2, and third gaps SP3. The first gap SP1 corresponds to a portion of the gap SP which extends in the fourth direction D4; the second gaps SP2 correspond to portions of the gap SP at the ends in the third direction D3 and in the direction opposite to the third direction D3, each of which extends in a direction other than the fourth direction D4, or in the third direction D3 in this embodiment. The third gaps SP3 correspond to portions of the gap SP which couple the first gap SP1 to both the second gaps SP2. In this embodiment, the third gaps SP3 extend in the second direction D2 from the ends of the first gap SP1 in the fourth direction D4 and the direction opposite to the fourth direction D4. As illustrated in FIG. 15, a length L1 of the first gap SP1 in the second direction D2 is set to be smaller than a length Lw of the end of the wiping member 51 in the second direction D2 which is to be brought into contact with each wiping surface WP.

As illustrated in FIG. 14, the first wiping surface WP1 has first regions R1, each of which protrudes toward the second liquid ejecting head 100B beyond an imaginary line LN1, as viewed from the direction opposite to the first direction D1. The imaginary line LN1 extends in the fourth direction D4 so as to overlap the first gap SP1. More specifically, the imaginary line LN1 extends in the fourth direction D4 so as to overlay the side of the first gap SP1 in the direction opposite to the second direction D2. In this embodiment, the first regions R1 are provided in the fourth surfaces PL4 of the first projections 330 of the holder 140. In this embodiment, each first projection 330 thus protrudes from the above imaginary line LN1 toward the second liquid ejecting head 100B in the second direction D2 as viewed from the direction opposite to the first direction D1. The first wiping surface WP1 has a first side and a second side: the first side is a side of the first wiping surface WP1 in the second direction D2 and in the fourth direction D4; and the second side is a side of the first wiping surface WP1 in the second direction D2 and the direction opposite to the fourth direction D4. In this embodiment, the first regions R1 are provided on both the first and second sides. Each of the first regions R1 in the first liquid ejecting head 100A is positioned at a different location in the third direction D3 from that of any of the head chips 200 in the second liquid ejecting head 100B. In other words, the first regions R1 of the first wiping surface WP1 are positioned shifted from the head chips 200 in the second liquid ejecting head 100B in the third direction D3 and the direction opposite to the third direction D3.

In this embodiment, the fourth surfaces PL4 of the first projections 330 protrude from an imaginary line LN2 toward the second liquid ejecting head 100B in the second direction D2 as viewed from the direction opposite to the first direction D1. Each first region R1 of the first wiping surface WP1 protrudes toward the second liquid ejecting head 100B beyond the imaginary line LN2*l* that extends in the fourth direction D4 so as to overlap the first gap SP1, as viewed from the direction opposite to the first direction D1. Further, the imaginary line LN2 extends in the fourth direction D4 so as to overlay the side of the first gap SP1 in the second direction D2. In this embodiment, each first region R1 protrudes toward the second liquid ejecting head 100B in the second direction D2 beyond both the imaginary lines LN1 and LN2, as viewed from the direction opposite to the first direction D1.

When the wiping member 51 moves under the gap SP between liquid ejecting heads 100 in order to remove the inks I, the end of the wiping member 51 is inserted into the gap SP. At this time, the wiping member 51 would vibrate, thereby splashing the inks I around the liquid ejecting heads 100. In this embodiment, however, the first regions R1 provided in each wiping surface WP keep in contact with portions of the wiping member 51 when the wiping member 51 moves under the gap SP, thereby hindering the end of the wiping member 51 from being inserted into the gap SP between the liquid ejecting heads 100. In this way, the first regions R1 can hinder the end of the wiping member 51 from being inserted into the gap SP as long as each first region R1 protrudes toward the second liquid ejecting head 100B beyond the imaginary line LN1. However, each first region R1 more preferably protrudes toward the second liquid ejecting head 100B in the second direction D2 beyond both the imaginary lines LN1 and LN2 because each first region R1 can more reliably hinder the end of the wiping member 51 from being inserted into the gap SP.

In the foregoing first embodiment, the liquid ejecting apparatus 10 is configured such that the first wiping surface WP1 in the first liquid ejecting head 100A is provided with the first regions R1 each of which protrudes toward the second liquid ejecting head 100B beyond the imaginary line LN1, as viewed from the direction opposite to the first direction D1. This configuration hinders the end of the wiping member 51 from being inserted into the gap SP between the first liquid ejecting head 100A and the second liquid ejecting head 100B, thereby successfully suppressing the inks I from splashing around the liquid ejecting heads 100 upon wiping of the wiping surfaces WP1 without using spacers embedded in the respective gaps SP. Therefore, the configuration involves no complex process of assembling the head unit 30 and requires no additional components, which would otherwise lead to cost rise. Further, each first region R1 protrudes toward the second liquid ejecting head 100B beyond both the imaginary lines LN1 and LN2 as viewed from the direction opposite to the first direction D1. This configuration more effectively hinders the end of the wiping member 51 from being inserted into the gap SP between the first liquid ejecting head 100A and the second liquid ejecting head 100B, thereby more reliably suppressing the inks I from splashing upon the wiping of the wiping surfaces WP1.

The above liquid ejecting apparatus 10 is configured such that each of the first regions R1 in the first liquid ejecting head 100A is positioned at a different location in the third direction D3 from that of any of the head chips 200 in the second liquid ejecting head 100B. This configuration successfully provides the first regions R1 without increasing the distance between the opposing head chips 200 in the first liquid ejecting head 100A and the second liquid ejecting head 100B.

The above liquid ejecting apparatus 10 is configured such that each gap SP is provided with the second gaps SP2 at its sides in the third direction D3 and in the direction opposite to the third direction D3 so as to extend in a direction different from the fourth direction D4, namely, in the third direction D3. This configuration hinders the end of the wiping member 51 from being inserted into the second gap SP2 as opposed to a configuration in which second gaps SP2 extend in the fourth direction D4, thereby successfully suppressing the inks I from splashing inside and around the second gap SP2.

The above liquid ejecting apparatus 10 is configured such that the first projections 330 provided in the third holder member 143 in each liquid ejecting head 100 extend from the fourth surface PL4 beyond the center O, in the first direction D1, of the junction between the main body 310 and the wall 320 of the third holder member 143, thereby providing the first projections 330 with high stiffness. Therefore, each first projection 330 is less likely to be deformed even when the wiping member 51 presses the first wiping surface WP1. Moreover, each first projection 330 extends from the fourth surface PL4 to its opposite surface of the third holder member 143, thereby providing the first projections 330 with sufficiently high stiffness.

The above liquid ejecting apparatus 10 is configured such that the conductive plates 90 are provided to ground the fixed plates 150, thereby successfully suppressing each fixed plate 150 from acting as an antenna. More specifically, the conductive plates 90 are provided to suppress the second interconnection substrates 246 and other components from radiating noise through the fixed plates 150. Moreover, the conductive plates 90 each having the above function are provided so as to cover the gaps between the adjacent liquid ejecting heads 100, thereby blocking the inks I from flying to the outside even when the inks I splash in the head unit 30. In short, providing the conductive plates 90 in this manner successfully suppresses the inks I from flying from the head unit 30 to the outside.

The above liquid ejecting apparatus 10 is configured such that the six head chips 200 arranged side by side in the second direction D2 in each liquid ejecting head 100 are surrounded by four sidewalls. One of the sidewalls which is positioned on the side in the second direction D2 is formed by the first wall 321 of the holder 140, whereas the sidewall on the opposite side is formed by the first bent section 152 of the fixed plate 150. As an example, if the sidewall on the side in the second direction D2 is formed by the first wall 321 of the holder 140 and the sidewall on the opposite side is formed by a wall that is as thick as the first wall 321 of the holder 140, it would be difficult to arrange the opposing head chips 200 in the adjacent liquid ejecting heads 100 at short intervals, because thick walls of the holder 140 are positioned adjacent to each other when the liquid ejecting heads 100 are arranged side by side. In short, it would be difficult to closely arrange the liquid ejecting heads 100 side by side. As another example, if the sidewall on the side in the direction opposite to the second direction D2 is formed by the first bent section 152 of the fixed plate 150 and the sidewall on the opposite side is formed by a bent section that is as thin as the first bent section 152 in order to arrange the head chips 200 in the liquid ejecting head 100 at short intervals, it would be necessary to reserve large gaps SP between the liquid ejecting head 100. This is because it is difficult to bend the bent sections at a right angle with respect to the first surface PL1 of the planar section 151 during a manufacturing process. As a result, each bent section is bent at an obtuse angle with respect to the first surface PL1. In this case, the end of the wiping member 51 is inserted into those large gaps SP, thereby supposedly splashing the inks I. As still another example, if spacers are embedded in the respective gaps SP in order to prevent the end of the wiping member 51 from being inserted into the gaps SP, some additional components would be required, which may lead to a complicated assembly process and cost rise. In this embodiment, however, the liquid ejecting apparatus 10, which is configured such that the liquid ejecting heads 100 are closely arranged side by side in the second direction D2, successfully addresses those disadvantages.

The above liquid ejecting apparatus 10 is configured such that portions of the first wall 321 protrude from the main body 310 in the second direction D2 as viewed in the cross-section vertical to the third direction D3. This configuration enables the liquid ejecting heads 100 to be arranged side by side in the second direction D2 with small gaps SP therebetween as opposed to a configuration in which portions of the first walls 321 do not protrude from the main body 310 in the second direction D2.

The above liquid ejecting apparatus 10 is configured such that the side of the planar section 151 of each fixed plate 150 in the second direction D2 protrudes from the first wall 321 in the second direction D2 as viewed in the cross-section vertical to the third direction D3. This configuration enables the liquid ejecting heads 100 to be arranged side by side in the second direction D2 with small gaps SP therebetween, as opposed to a configuration in which the side of a planar section 151 of each fixed plate 150 in the second direction D2 does not protrude from a first wall 321 in the second direction D2.

The above liquid ejecting apparatus 10 is configured such that the first walls 321 of the holders 140 and the first bent sections 152 of the fixed plates 150 are inclined at substantially the same angle with respect to the first surface PL1 provided in the planar sections 151 of the fixed plates 150. This configuration successfully enables the liquid ejecting heads 100 to be arranged side by side in the second direction D2 with small gaps SP therebetween.

The above liquid ejecting apparatus 10 is configured such that the end of each first wall 321 in the fourth direction D4 is coupled to the third wall 323, whereas the other end of each first wall 321 is coupled to the second wall 322. Both of the second wall 322 and the third wall 323 help reinforce the first wall 321, thereby suppressing the first wall 321 from being deformed.

The above liquid ejecting apparatus 10 is configured such that, of the four sidewalls surrounding the six head chips 200 in each liquid ejecting head 100, one on the side in the second direction D2 is formed by the first wall 321, made of a resin material, of the holder 140, and another one on the side in the opposite direction is formed by the first bent section 152, made of a metal material, of the fixed plate 150. In general, metal materials can be easily formed thinner than resin materials. Therefore, the sidewall, made of a metal material, on the side in the direction opposite to the second direction D2 can be formed thin. Consequently, a portion of each liquid ejecting head 100 positioned in the second direction D2 can be made compact.

The above liquid ejecting apparatus 10 is configured such that the liquid ejecting heads 100 are arranged side by side with the first walls 321, thicker than the first bent sections 152 of the fixed plates 150, oriented in substantially the same direction. In this case, the first walls 321 of the adjacent liquid ejecting heads 100 do not face each other. This configuration successfully enables the liquid ejecting heads 100 to be closely arranged side by side.

The above liquid ejecting apparatus 10 is configured such that each liquid ejecting head 100 is provided with nozzle arrays extending in the fourth direction D4. Therefore, the liquid ejecting heads 100 are arranged side by side in the second direction D2 with their nozzle arrays partly aligned with one another in the third direction D3. Thus, this configuration successfully reduces the risk of unevenly dense printing occurring between the adjacent liquid ejecting heads 100.

The above liquid ejecting apparatus 10 is configured such that the interval between the adjacent head chips 200 in the second direction D2 is set to be substantially the same as the distance between the opposing head chips 200 in the adjacent liquid ejecting heads 100 in the second direction D2. This configuration enables the head chips 200 to be arranged at substantially the same interval, thereby successfully reducing the risk of unevenly dense printing.

The above liquid ejecting apparatus 10 is configured such that the length L1 of the first gap SP1 formed between the adjacent liquid ejecting heads 100 in the second direction D2 is set to be smaller than the length Lw of the end of the wiping member 51 in the second direction D2 which is to be brought in contact with the wiping surface WP. This configuration successfully suppresses the end of the wiping member 51 from being inserted into the gap SP between the adjacent liquid ejecting heads 100.

The above liquid ejecting apparatus 10 is configured such that the liquid ejecting heads 100 are arranged side by side in the second direction D2 and such that the wiping member 51 sequentially wipes the nozzle surfaces PN by moving relative to each liquid ejecting head 100 in the second direction D2. In this case, when wiping the fixed plate 150 in a liquid ejecting head 100, the wiping member 51 is brought into contact with the fixed plate 150 from the side on which the first bent section 152 is provided. This configuration successfully reduces the risk of the wiping member 51 hitting and damaging an edge of the fixed plate 150. This effect is prominent especially when the side of the planar section 151 of each fixed plate 150 in the second direction D2 protrudes from a corresponding first wall 321 in the second direction D2 as viewed in the cross-section vertical to the third direction D3.

B. Second Embodiment

Figure 16:
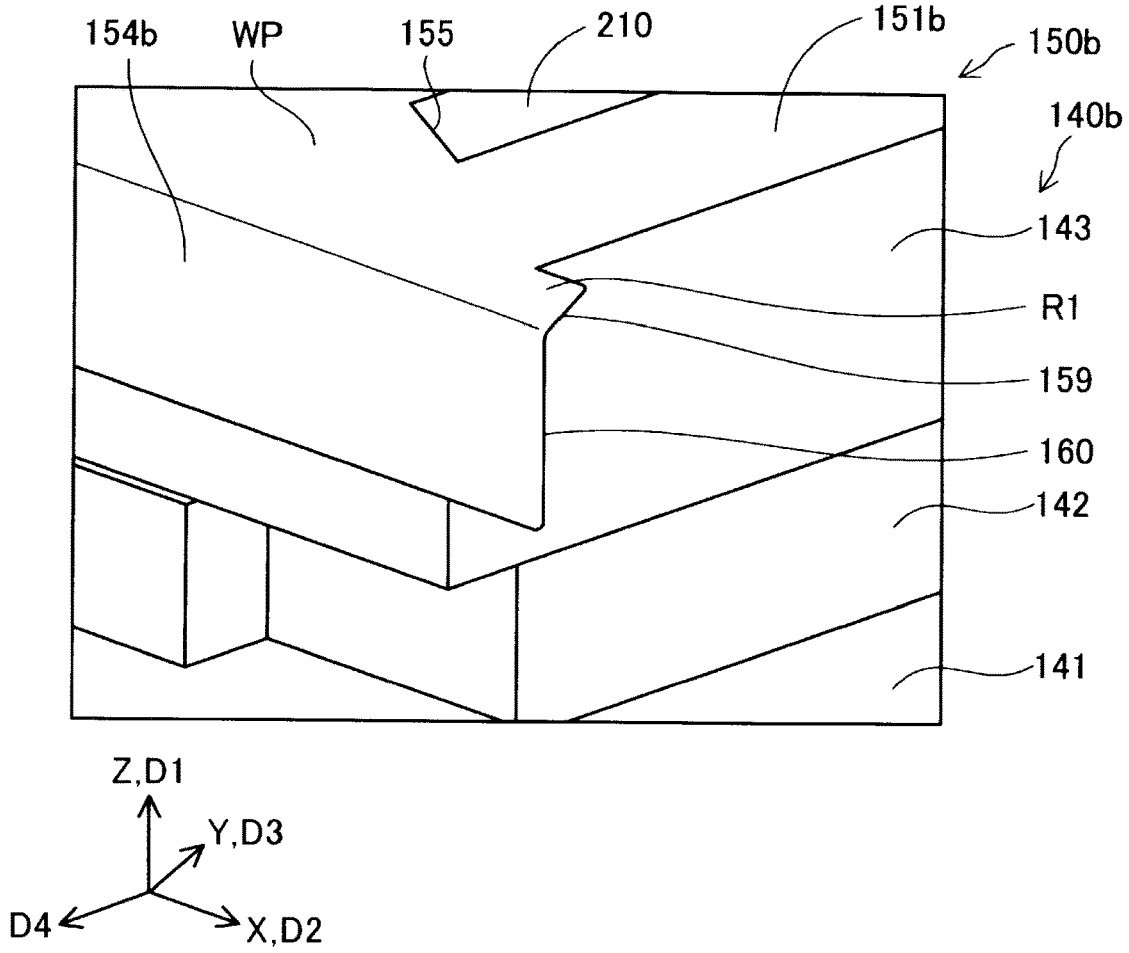
FIG. 16 schematically illustrates a configuration of a liquid ejecting apparatus according to a second embodiment of the present disclosure.

FIG. 16 schematically illustrates a configuration of a liquid ejecting apparatus 10 according to a second embodiment of the present disclosure. The liquid ejecting apparatus 10 in the second embodiment differs from the liquid ejecting apparatus 10 in the foregoing first embodiment in that first regions R1 of the wiping surfaces WP1 are provided in fixed plates 150*b* instead of second holders 140*b*. Other configurations in this embodiment are substantially the same as those in the foregoing first embodiment unless otherwise stated.

In this embodiment, instead of first projections 330 of each holder 140*b*, each fixed plate 150*b* has a planar section 151*b* provided with a second projection 159 that protrudes in the second direction D2. Further, the planar section 151*b* has two second projections 159 on the respective sides in the third direction D3 and in the direction opposite to the third direction D3. Each of the second projections 159 is provided with the first region R1 of the wiping surface WP1. In this embodiment, a third bent section 154*b* has a third projection 160 coupled to the second projection 159. The third projection 160 is a portion provided on the side, in the direction opposite to the third direction D3, of the second projection 159 of the third bent section 154*b*. The second projection 159 is coupled to the third projection 160 at an angle. Providing the third projection 160 in the third bent section 154*b* can suppress the second projection 159 from being deformed when a wiping member 51 presses the first region R1, as opposed to a configuration in which no third projection 160 is provided in the third bent section 154*b*. In this embodiment, a second bent section 153 (not illustrated) also has another third projection 160, similar to the third bent section 154*b*. However, the second bent section 153 or third bent section 154*b* does not necessarily have to have a third projection 160.

In this embodiment, as described above, the liquid ejecting apparatus 10 is configured such that the first region R1 is provided in the second projection 159 of the fixed plate 150*b* in each liquid ejecting head 100. This configuration successfully suppresses the end of the wiping member 51 from being inserted into gaps SP between the liquid ejecting heads 100.

C. Third Embodiment

Figure 17:
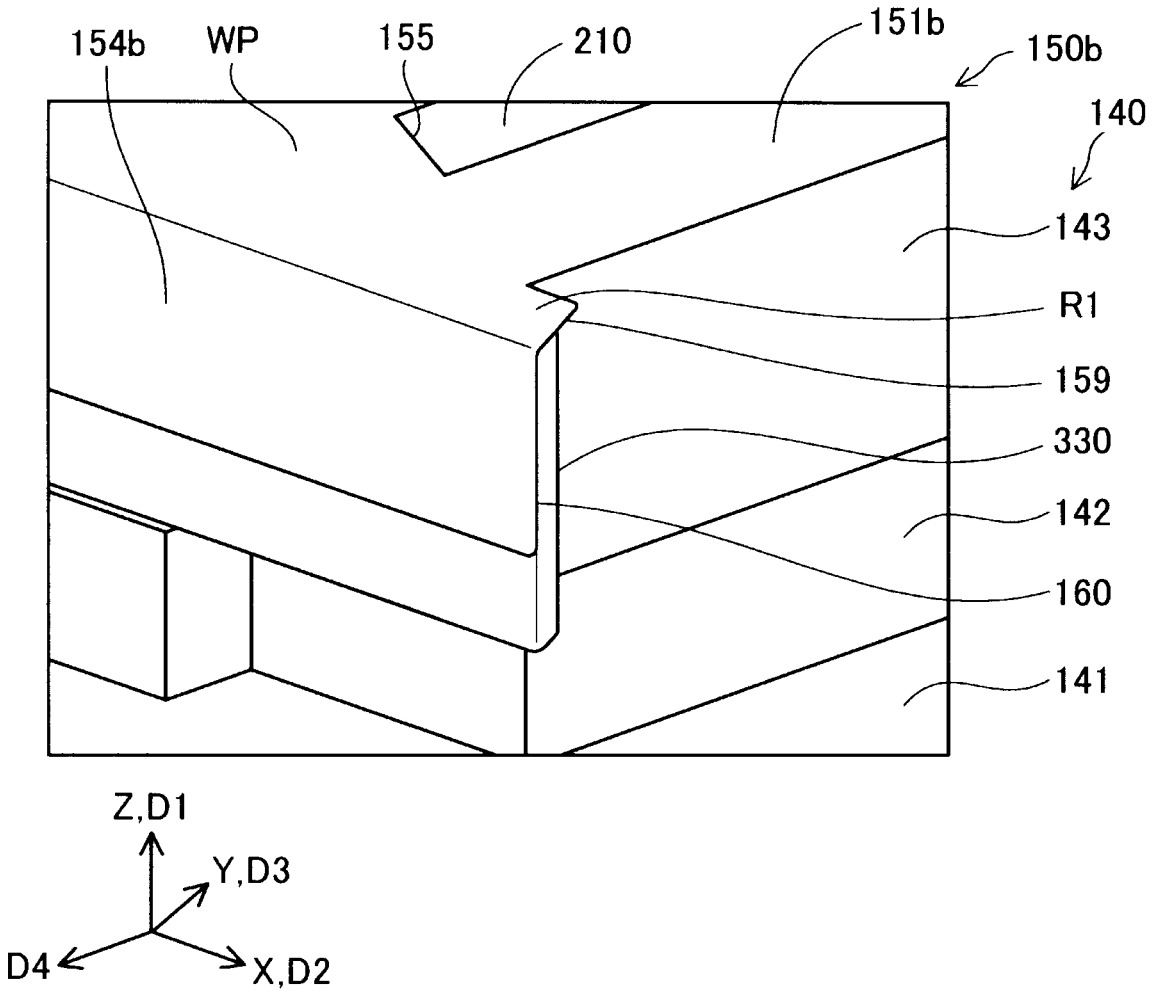
FIG. 17 schematically illustrates a configuration of a liquid ejecting apparatus according to a third embodiment of the present disclosure.

FIG. 17 schematically illustrates a configuration of a liquid ejecting apparatus 10 according to a third embodiment of the present disclosure. The liquid ejecting apparatus 10 in the third embodiment differs from the liquid ejecting apparatus 10 in the foregoing first embodiment in that first regions R1 of a wiping surface WP1 are provided in each fixed plate 150*b* instead of each holder 140. Other configurations in this embodiment are substantially the same as those in the foregoing first embodiment unless otherwise stated.

The configuration of each holder 140 in this embodiment is substantially the same as that in the foregoing first embodiment. The fixed plate 150*b* has a planar section 151*b* provided with second projections 159, similar to the fixed plate 150*b* in the foregoing second embodiment. Each of the second projections 159 is provided with the first region R1 of the wiping surface WP1. In this embodiment, the second projections 159 are in contact with the respective first projections 330. More specifically, the surfaces of the second projections 159 opposite the wiping surface WP1 are in contact with fourth surfaces PL4 of the first projections 330. In this embodiment, a second bent section 153 of the fixed plate 150*b* and the third bent section 154*b* have third projections 160, similar to those in the foregoing second embodiment. However, the second bent section 153 or the third bent section 154*b* does not necessarily have to have a third projection 160.

As described above, the liquid ejecting apparatus 10 in this embodiment is configured such that the first region R1 is provided in the second projection 159 of the fixed plate 150*b* in each liquid ejecting head 100. This configuration successfully suppresses the end of a wiping member 51 from being inserted into gaps SP between the liquid ejecting heads 100. Furthermore, in this embodiment, the first projections 330 of the holder 140 help reinforce the second projections 159 of the second fixed plate 150B, thereby successfully suppressing the second projections 159 from being deformed when the wiping member 51 presses the first region R1.

D. Modifications (D1) The liquid ejecting apparatus 10 in each of the foregoing embodiments is configured such that the first regions R1 are provided on the respective sides, in the third direction D3 and the direction opposite to the third direction D3, of the wiping surface WP1 in each liquid ejecting head 100. Alternatively, a first region R1 may be provided on one of both sides of the wiping surface WP1. This configuration enables the liquid ejecting heads 100A to 100F to be arranged more easily side by side in the second direction D2. As described above, the inks I removed by the wiping member 51 tend to flow in the direction opposite to the third direction D3 and splash on or near the side of the liquid ejecting heads 100 in the direction opposite to the third direction D3. Therefore, the first region R1 is preferably provided on the side of the wiping surface WP in the direction opposite to the third direction D3, namely, in the fourth direction D4.

(D2) The liquid ejecting apparatus 10 in each of the foregoing embodiments is configured such that each first region R1 in the first liquid ejecting head 100A is positioned at a different location in the third direction D3 from that of any of the head chips 200 in the second liquid ejecting head 100B. Alternatively, each first region R1 in the first liquid ejecting head 100A may be positioned at substantially the same location in the third direction D3 as that of any of the head chips 200 in the second liquid ejecting head 100B. In other words, when each first region R1 in the first liquid ejecting head 100A and the head chips 200 in the second liquid ejecting head 100B are projected onto a surface vertical to the second direction D2, each first region R1 in the first liquid ejecting head 100A may overlap the head chips 200 in the second liquid ejecting head 100B in the first direction D1.

(D3) The liquid ejecting apparatus 10 in each of the foregoing embodiments is configured such that the gaps SP provided between the liquid ejecting heads 100 include the second gaps SP2 each of which protrudes in a direction different from that of the first gap SP1. Alternatively, each gap SP may include no second gaps SP2.

(D4) The liquid ejecting apparatus 10 in each of the foregoing embodiments is configured such that the first projections 330 provided in the third holder member 143 protrude from the fourth surface PL4 to the center O, in the first direction D1, of the junction between the main body 310 and the wall 320 of the third holder member 143. Alternatively, the first projections 330 do not necessarily have to protrude to the center O.

(D5) The liquid ejecting apparatus 10 in each of the foregoing embodiments is configured such that the conductive plates 90 are provided in the head unit 30. Alternatively, no conductive plates 90 may be provided in the head unit 30.

(D6) The liquid ejecting apparatus 10 in each of the foregoing embodiments is configured such that the first wall 321 provided in the third holder member 143 partly protrudes from the main body 310 in the second direction D2. Alternatively, the first wall 321 does not necessarily have to protrude from the main body 310.

(D7) The liquid ejecting apparatus 10 in each of the foregoing embodiments is configured such that the end of the planar section 151 of the fixed plate 150 in the second direction D2 protrudes from the first wall 321 in the second direction D2. Alternatively, the end of the planar section 151 does not necessarily have to protrude from the first wall 321.

(D8) The liquid ejecting apparatus 10 in each of the foregoing embodiments is configured such that the first wall 321 is coupled to both the second wall 322 and the third wall 323 in the third holder member 143. Alternatively, the first wall 321 may be separated from one or both of the second wall 322 and the third wall 323.

(D9) The liquid ejecting apparatus 10 in each of the foregoing embodiments is configured such that the holder 140 is not present between the first bent section 152 of the fixed plate 150 and a first one of the six head chips 200 in each liquid ejecting head 100 as viewed from the second direction D2. Alternatively, the holder 140 may be partly present between the first bent section 152 and the first head chip 200. For example, the wall 320 of the holder 140 may be present therebetween.

(D10) The liquid ejecting apparatus 10 in each of the foregoing embodiments is configured such that the first wall 321 of the holder 140 and the first bent section 152 of the fixed plate 150 in each liquid ejecting head 100 are inclined at substantially the same angle with respect to the first surface PL1. Alternatively, the first wall 321 and the first bent section 152 may be inclined differently.

(D11) The liquid ejecting apparatus 10 in each of the foregoing embodiments is configured such that the first walls 321 in the liquid ejecting heads 100 are arranged oriented in substantially the same direction. Alternatively, one or more of the first walls 321 in the liquid ejecting heads 100 may be oriented in a different direction.

(D12) The liquid ejecting apparatus 10 in each of the foregoing embodiments is configured such that the interval, in the second direction D2, between the adjacent head chips 200 in each liquid ejecting head 100 is substantially the same as the interval, in the second direction D2, between the opposing head chips 200 in adjacent liquid ejecting heads 100. Alternatively, both the intervals may differ from each other.

(D13) The liquid ejecting apparatus 10 in each of the foregoing embodiments is configured such that the length L1 of the first gap SP1 in the second direction D2 is set to be smaller than the length Lw of the end of the wiping member 51 in the second direction D2 which is to be brought into contact with a wiping surface WP1. Alternatively, the length L1 may be greater than the length Lw.

E. Other Aspects

The present disclosure is not limited to the foregoing embodiments and modifications and may be implemented by various aspects without departing from the spirit. For example, the present disclosure can be implemented by the aspects described below. The technical features in the foregoing embodiments and modifications which are related to those in the aspects may be replaced with others or combined together as appropriate in order to enhance some or all effects of the present disclosure and/or accomplish some or all purposes of the present disclosure. Some of the technical features may be omitted as appropriate unless they are essential herein.

(1) According to an aspect of the present disclosure, a liquid ejecting apparatus that includes a first liquid ejecting head which discharges a liquid in a first direction. This first liquid ejecting head has a first wiping surface oriented in the first direction. A second liquid ejecting head, which is disposed in a second direction of the first liquid ejecting head, has a second wiping surface oriented in the first direction, the second direction being orthogonal to the first direction. A wiping member wipes the first wiping surface and the second wiping surface. A third direction is orthogonal to both the first direction and the second direction; a fourth direction is vertical to the first direction and intersects both the second direction and the third direction. The first liquid ejecting head and the second liquid ejecting head are arranged with a gap between the first wiping surface and the second wiping surface as viewed from a direction opposite to the first direction. The gap includes a first gap extending in the fourth direction. The first wiping surface has a first region that protrudes toward the second liquid ejecting head beyond an imaginary line that extends in the fourth direction so as to overlap the first gap as viewed from the direction opposite to the first direction.

The above liquid ejecting apparatus includes a first liquid ejecting head that has a first wiping surface provided with a first region protruding toward a second liquid ejecting head. This configuration hinders an end of a wiping member from being inserted into a gap between the first liquid ejecting head and the second liquid ejecting head, thereby successfully suppressing a liquid from splashing upon wiping of the first wiping surface without using a spacer embedded in the gap. Consequently, this liquid ejecting apparatus involves no complex process of assembling the head unit and requires no additional components, which would otherwise lead to cost rise.

(2) In the above liquid ejecting apparatus, the first liquid ejecting head may include a plurality of first head chips arranged side by side in the second direction. A holder may have a main body to which the plurality of first head chips are fixed and a wall erected from the main body in the first direction. A first fixed plate may have a first surface that forms a portion of the first wiping surface and a second surface that is on an opposite side of the first surface and to which the plurality of first head chips are fixed. The wall of the holder may include a third surface fixed to the second surface of the first fixed plate. Each of the plurality of first head chips may include: a nozzle plate that forms a portion of the first wiping surface and that has a plurality of nozzles through which the liquid is to be discharged; and a case that contains a passage leading to the plurality of nozzles. The holder may have a first projection that protrudes toward the second liquid ejecting head beyond the imaginary line as viewed from the direction opposite to the first direction. The first projection may include a fourth surface continuing to the third surface of the wall. The fourth surface may form the first region in the first wiping surface.

The above liquid ejecting apparatus may include a first liquid ejecting head having a first wiping surface provided with a first region protruding toward a second ejecting head. This configuration hinders an end of a wiping member from being inserted into a gap between the first liquid ejecting head and the second liquid ejecting head.

(3) In the above liquid ejecting apparatus, the first liquid ejecting head may include a plurality of first head chips arranged side by side in the second direction. A holder may have a main body to which the plurality of first head chips are fixed and a wall erected from the main body in the first direction. A first fixed plate may have a first surface that forms a portion of the first wiping surface and a second surface that is on an opposite side of the first surface and to which the plurality of first head chips are fixed. The wall of the holder may include a third surface fixed to the second surface of the first fixed plate. Each of the plurality of first head chips may include: a nozzle plate that forms a portion of the first wiping surface and that has a plurality of nozzles through which the liquid is to be discharged; and a case that contains a passage leading to the plurality of nozzles. The holder may have a first projection that protrudes toward the second liquid ejecting head beyond the imaginary line as viewed from the direction opposite to the first direction. The first projection may include a fourth surface continuing to the third surface of the wall. The first fixed plate may have a second projection that protrudes toward the second liquid ejecting head beyond the imaginary line as viewed from the direction opposite to the first direction. The second projection may be provided with the first region in the first wiping surface and may be in contact with the first projection.

The above liquid ejecting apparatus successfully suppresses the second projection from being deformed by reinforcing the second projection of the first fixed plate with the first projection of the holder.

(4) In the above liquid ejecting apparatus, the first liquid ejecting head may include a plurality of first head chips arranged side by side in the second direction. A first fixed plate may have a first surface that forms a portion of the first wiping surface and a second surface that is on an opposite side of the first surface and to which the plurality of first head chips are fixed. Each of the plurality of first head chips may include: a nozzle plate that forms a portion of the first wiping surface and that has a plurality of nozzles through which the liquid is to be discharged; and a case that contains a passage leading to the plurality of nozzles. The first fixed plate may have a second projection that protrudes toward the second liquid ejecting head beyond the imaginary line as viewed from the direction opposite to the first direction. The second projection may be provided with the first region in the first wiping surface.

The above liquid ejecting apparatus may include a first liquid ejecting head having a first wiping surface provided with a first region protruding toward a second ejecting head. This configuration successfully hinders an end of a wiping member from being inserted into a gap between the first liquid ejecting head and the second liquid ejecting head.

(5) In the above liquid ejecting apparatus, the second liquid ejecting head may include a plurality of second head chips arranged side by side in the second direction. The first region in the first liquid ejecting head may be positioned at a different location in the third direction from that of any of the plurality of second head chips in the second liquid ejecting head.

The above configuration enables the liquid ejecting apparatus to reserve a first region without increasing a gap between a first head chip and a second head chip.

(6) In the above liquid ejecting apparatus, the gap may further include a second gap that extends in a direction different from the fourth direction, the second gap being formed at an end of the gap in the third direction.

The above liquid ejecting apparatus suppresses a liquid from splashing in or near a second gap more effectively than a liquid ejecting apparatus in which a second gap is formed so as to extend in a fourth direction.

(7) In the above liquid ejecting apparatus, the first projection of the holder may protrude from the fourth surface beyond a center of a junction between the main body and the wall of the holder in the first direction.

The above configuration enables the liquid ejecting apparatus to have a stiff first projection.

(8) In the above liquid ejecting apparatus, the first projection of the holder may protrude from the fourth surface to a surface of the main body in the direction opposite to the first direction.

The above configuration enables the liquid ejecting apparatus to have a stiff first projection.

(9) In the above liquid ejecting apparatus, the first region may be provided at one of sides of the first wiping surface in the third direction and in a direction opposite to the third direction.

The above configuration enables the liquid ejecting apparatus to arrange the first liquid ejecting head and the second liquid ejecting head side by side more easily than a configuration in which first regions are provided on both sides of a first wiping surface.

(10) In the above liquid ejecting apparatus, the wiping member may have a rectangular shape with longer sides extending in the fourth direction as viewed from the direction opposite to the first direction. The wiping member may wipe the first wiping surface and the second wiping surface by moving in the second direction relative to the first liquid ejecting head and the second liquid ejecting head.

The above liquid ejecting apparatus may include a first liquid ejecting head that has a first wiping surface provided with a first region protruding toward a second liquid ejecting head. This configuration hinders an end of a wiping member from being inserted into a gap between the first liquid ejecting head and the second liquid ejecting head.

(11) In the liquid ejecting apparatus, the first wiping surface may have a first side and a second side, the first side being a side of the first wiping surface in the second direction and in the fourth direction, the second side being a side of the first wiping surface in the second direction and in a direction opposite to the fourth direction. The second side may be positioned in the second direction of the first side. The first region may be provided on the first side.

In the above liquid ejecting apparatus, a wiping member with its longer sides extending in a fourth direction moves in a second direction relative to a first liquid ejecting head and a second liquid ejecting head, thereby causing a liquid to flow from a second side to a first side. Therefore, providing the first region on the first side successfully suppresses a liquid from splashing effectively.

(12) The above liquid ejecting apparatus may further include: a support member that conducts electricity and to which the first liquid ejecting head and the second liquid ejecting head are fixed; and a conductive plate that conducts electricity and that partly covers surfaces of the first liquid ejecting head and the second liquid ejecting head in the third direction or surfaces of the first liquid ejecting head and the second liquid ejecting head in a direction opposite to the third direction. The first liquid ejecting head may include: a plurality of first head chips arranged side by side in the second direction; and a first fixed plate that forms a portion of the first wiping surface and to which the plurality of first head chips are fixed. The second liquid ejecting head may include: a plurality of second head chips arranged side by side in the second direction; and a second fixed plate that forms a portion of the second wiping surface and to which the plurality of first head chips are fixed. The conductive plate may electrically connect the support member, the first fixed plate, and the second fixed plate.

The above configuration enables the liquid ejecting apparatus to suppress a liquid from splashing with a conductive plate by which the first fixed plate and the second fixed plate are grounded.

The present disclosure has any other applications in addition to liquid ejecting apparatuses. For example, the present disclosure may be applied to head units.

What is claimed is:

1. A liquid ejecting apparatus comprising:

a first liquid ejecting head configured to discharge a liquid in a first direction, the first liquid ejecting head having a first wiping surface oriented in the first direction;

a second liquid ejecting head disposed in a second direction with respect to the first liquid ejecting head, the second liquid ejecting head having a second wiping surface oriented in the first direction, the second direction being orthogonal to the first direction; and a wiping member wiping the first wiping surface and the second wiping surface, a third direction being orthogonal to both the first direction and the second direction, a fourth direction being vertical to the first direction and intersecting both the second direction and the third direction, the first liquid ejecting head and the second liquid ejecting head being arranged with a gap between the first wiping surface and the second wiping surface as viewed in a direction opposite to the first direction, the gap including a first gap extending in the fourth direction, the first wiping surface having a first region, the first region protruding toward the second liquid ejecting head beyond an imaginary line, the imaginary line extending in the fourth direction so as to overlap the first gap as viewed in the direction opposite to the first direction, wherein the first liquid ejecting head includes:

first head chips arranged side by side in the second direction;

a holder having a main body to which the first head chips are fixed, and a wall erected from the main body in the first direction; and a first fixed plate having a first surface that forms a portion of the first wiping surface, and a second surface that is opposite from the first surface and to which the first head chips are fixed, the wall of the holder includes a third surface fixed to the second surface of the first fixed plate, each of the first head chips includes:

a nozzle plate that forms a portion of the first wiping surface and that has nozzles through which the liquid is to be discharged; and a case that contains a passage lading to the nozzles, the holder has a first projection that protrudes toward the second liquid ejecting head beyond the imaginary line as viewed in the direction opposite to the first direction, the first projection includes a fourth surface continuing to the third surface of the wall, and the fourth surface forms the first region in the first wiping surface.

2. The liquid ejecting apparatus according to claim 1, wherein the second liquid ejecting head includes second head chips arranged side by side in the second direction, and the first region in the first liquid ejecting head is positioned at a different location with respect to the third direction from that of any of the second head chips in the second liquid ejecting head.

3. The liquid ejecting apparatus according to claim 1, wherein the gap further includes a second gap that extends in a direction different from the fourth direction, the second gap being formed at an end of the gap in the third direction.

4. The liquid ejecting apparatus according to claim 1, wherein the first projection of the holder protrudes from the fourth surface beyond a center of a junction between the main body and the wall of the holder in the first direction.

5. The liquid ejecting apparatus according to claim 1, wherein the first projection of the holder protrudes from the fourth surface to a surface of the main body in the direction opposite to the first direction.

6. The liquid ejecting apparatus according to claim 1, wherein the first region is provided at one of a side of the first wiping surface in the third direction and another side of the first wiping surface in a direction opposite to the third direction.

7. The liquid ejecting apparatus according to claim 1, wherein the wiping member has a rectangular shape with longer sides extending in the fourth direction as viewed in the direction opposite to the first direction, and the wiping member wipes the first wiping surface and the second wiping surface by moving in the second direction relative to the first liquid ejecting head and the second liquid ejecting head.

8. The liquid ejecting apparatus according to claim 7, wherein the first wiping surface has a first corner and a second corner, the first corner being a side of the first wiping surface in the second direction and in the fourth direction, the second corner being a side of the first wiping surface in the second direction and in a direction opposite to the fourth direction, the second corner is positioned in the second direction of the first corner, and the first region is provided on the first corner.

9. A liquid ejecting apparatus comprising:

a first liquid ejecting head configured to discharge liquid in a first direction, the first liquid ejecting head having a first wiping surface oriented in the first direction;

a second liquid ejecting head disposed in a second direction with respect to the first liquid ejecting head, the second liquid ejecting head having a second wiping surface oriented in the first direction, the second direction being orthogonal to the first direction; and a wiping member wiping the first surface and the second wiping surface, a third direction being orthogonal to both the first direction and the second direction, a fourth direction being vertical to the first direction and intersecting both the second direction and the third direction, the first liquid ejecting head and the second liquid ejecting head being arranged with a gap between the first wiping surface and the second wiping surface as viewed in a direction opposite to the first direction, the gap including a first gap extending in the fourth direction, the first wiping surface having a first region, the first region protruding toward the second liquid ejecting head beyond an imaginary line, the imaginary line extending in the fourth direction so as to overlap the first gap as viewed in the direction opposite to the first direction, wherein the first liquid ejecting head includes:

first head chips arranged side by side in the second direction;

a holder having a main body to which the first head chips are fixed, and a wall erected from the main body in the first direction; and a first fixed plate having a first surface that forms a portion of the first wiping surface and, a second surface that is opposite from the first surface and to which the first head chips are fixed, the wall of the holder includes a third surface fixed to the second surface of the first fixed plate, each of the first head chips includes:

a nozzle plate that forms a portion of the first wiping surface and that has nozzles through which the liquid is to be discharged; and a case that contains a passage leading to the nozzles, the holder has a first projection that protrudes toward the second liquid ejecting head beyond the imaginary line as viewed in the direction opposite to the first direction, the first projection includes a fourth surface continuing to the third surface of the wall, the first fixed plate has a second projection that protrudes toward the second liquid ejecting head beyond the imaginary line as viewed in the direction opposite to the first direction, and the second projection is provided with the first region in the first wiping surface and is in contact with the first projection.

10. The liquid ejecting apparatus according to claim 9, wherein the first projection of the holder protrudes from the fourth surface beyond a center of a junction between the main body and the wall of the holder in the first direction.

11. The liquid ejecting apparatus according to claim 9, wherein the first projection of the holder protrudes from the fourth surface to a surface of the main body in the direction opposite to the first direction.

12. The liquid ejecting apparatus according to claim 9, wherein the second liquid ejecting head includes second head chips arranged side by side in the second direction, and the first region in the first liquid ejecting head is positioned at a different location with respect to the third direction from that of any of the second head chips in the second liquid ejecting head.

13. The liquid ejecting apparatus according to claim 9, wherein the gap further includes a second gap that extends in a direction different from the fourth direction, the second gap being formed at an end of the gap in the third direction.

14. The liquid ejecting apparatus according to claim 9, wherein the first region is provided at one of a side of the first wiping surface in the third direction and another side of the first wiping surface in a direction opposite to the third direction.

15. The liquid ejecting apparatus according to claim 9, wherein the wiping member has a rectangular shape with longer sides extending in the fourth direction as viewed in the direction opposite to the first direction, and the wiping member wipes the first wiping surface and the second wiping surface by moving in the second direction relative to the first liquid ejecting head and the second liquid ejecting head.

16. The liquid ejecting apparatus according to claim 15, wherein the first wiping surface has a first corner and a second corner, the first corner being a side of the first wiping surface in the second direction and in the fourth direction, the second corner being a side of the first wiping surface in the second direction and in a direction opposite to the fourth direction, the second corner is positioned in the second direction of the first corner, and the first region is provided on the first corner.

17. A liquid ejecting apparatus comprising:

a first liquid ejecting head configured to discharge a liquid in a first direction, the first liquid ejecting head having a first wiping surface oriented in the first direction;

a second liquid ejecting head disposed in a second direction with respect to the first liquid ejecting head, the second liquid ejecting head having a second wiping surface oriented in the first direction, the second direction being orthogonal to the first direction; and a wiping member wiping the first wiping surface and the second wiping surface, a third direction being orthogonal to both the first direction and the second direction, a fourth direction being vertical to the first direction and intersecting both the second direction and the third direction, the first liquid ejecting head an the second liquid ejecting head being arranged with a gap between the first wiping surface and the second wiping surface as viewed in a direction opposite to the first direction, the gap including a first gap extending in the fourth direction, the first wiping surface having a first region, the first region protruding toward the second liquid ejecting head beyond an imaginary line, the imaginary line extending in the fourth direction so as to overlap the first gap as viewed in the direction opposite to the first direction, wherein the first liquid ejecting head includes:

first head chips arranged side by side in the second direction; and a first fixed plate having a first surface that forms a portion of the first wiping surface, and a second surface that is opposite from the first surface and to which the first head chips are fixed, each of the first head chips includes:

a nozzle plate that forms a portion of the first wiping surface and that has nozzles through which the liquid is to be discharged; and a case that contains a passage leading to the nozzles, the first fixed plate has a second projection that protrudes toward the second liquid ejecting head beyond the imaginary line as viewed in the direction opposite to the first direction, and the second projection is provided with the first region in the first wiping surface.

* * * * *